US010077773B2

(12) United States Patent
Yoshida et al.

(10) Patent No.: US 10,077,773 B2
(45) Date of Patent: Sep. 18, 2018

(54) TWO-SHAFT ROTARY PUMP WITH ESCAPE HOLES

(71) Applicant: ORION MACHINERY CO., LTD., Suzaka-shi, Nagano (JP)

(72) Inventors: Yosuke Yoshida, Suzaka (JP); Shingo Harayama, Suzaka (JP); Shun Miyazawa, Suzaka (JP); Humihiko Yamada, Suzaka (JP)

(73) Assignee: Orion Machinery Co., Ltd., Suzaka-Shi, Nagano (JP)

( * ) Notice: Subject to any disclaimer, the term of this patent is extended or adjusted under 35 U.S.C. 154(b) by 316 days.

(21) Appl. No.: 14/782,735

(22) PCT Filed: May 29, 2014

(86) PCT No.: PCT/JP2014/064229
§ 371 (c)(1),
(2) Date: Oct. 6, 2015

(87) PCT Pub. No.: WO2014/192851
PCT Pub. Date: Dec. 4, 2014

(65) Prior Publication Data

US 2016/0040669 A1 Feb. 11, 2016

(30) Foreign Application Priority Data

May 30, 2013 (JP) ..... 2013-114138
May 30, 2013 (JP) ..... 2013-114154

(51) Int. Cl.
*F04C 28/24* (2006.01)
*F04C 29/06* (2006.01)
(Continued)

(52) U.S. Cl.
CPC ..... *F04C 28/24* (2013.01); *F04C 18/123* (2013.01); *F04C 23/001* (2013.01); *F04C 25/02* (2013.01);
(Continued)

(58) Field of Classification Search
CPC ..... F04C 18/123; F04C 28/24
See application file for complete search history.

(56) References Cited

U.S. PATENT DOCUMENTS 3,677,664 A * 7/1972 Wycliffe ..... F04C 18/16 417/310
3,989,413 A * 11/1976 McGahan ..... F04C 18/123 417/310
(Continued)

FOREIGN PATENT DOCUMENTS

JP 59-218392 A 12/1984
JP 07243331 A * 9/1995
(Continued)

*Primary Examiner* — Mary A Davis
(74) *Attorney, Agent, or Firm* — Muncy, Geissler, Olds & Lowe, P.C.

(57) ABSTRACT

Provided is a two-shaft rotary pump which is capable of improving reliability and operation efficiency by preventing an exhaust gas from flowing backward into a pump as much as possible, preventing the interior of the pump form being excessively compressed as much as possible, and suppressing temperature rise in the pump. A two-shaft rotary pump in which two rotating shafts (20, 20) provided with rotors (30, 30) are supported by bearings, such that the two rotors (30, 30) are rotated in a noncontact manner with a small clearance kept therebetween and the two rotors (30, 30) are rotated in a noncontact manner with a small clearance between an inner surface of a cylinder (50) and the two rotors, and a gas sucked into the cylinder (50) and compressed is discharged from the cylinder (50), wherein an escape hole capable of letting a part of the compressed gas
(Continued)

escape is provided in at least one of end wall portions (52) constituting both ends of the cylinder (50) and opened in the axial direction of the rotating shafts (20, 20).

18 Claims, 15 Drawing Sheets

(51) Int. Cl.

| | |
|---|---|
| ***F04C 28/02*** | (2006.01) |
| ***F04C 23/00*** | (2006.01) |
| ***F04C 18/12*** | (2006.01) |
| ***F04C 28/26*** | (2006.01) |
| ***F04C 25/02*** | (2006.01) |

(52) U.S. Cl.
CPC ..... *F04C 28/02* (2013.01); *F04C 28/26* (2013.01); *F04C 29/065* (2013.01); *F04C 2240/51* (2013.01); *F04C 2270/17* (2013.01)

(56) References Cited

U.S. PATENT DOCUMENTS

| | | | | |
|---|---|---|---|---|
| 4,639,199 | A * | 1/1987 | Frings | F04C 28/24 418/15 |
| 5,846,062 | A * | 12/1998 | Yanagisawa | F04C 18/16 417/252 |
| 7,713,040 | B2 * | 5/2010 | Kimura | F04C 18/123 277/304 |
| 2008/0050262 | A1 * | 2/2008 | Jacobsen | F01C 1/20 418/191 |
| 2016/0273539 | A1 * | 9/2016 | Kobayashi | F04C 25/02 |

FOREIGN PATENT DOCUMENTS

| | | | |
|---|---|---|---|
| JP | 11-505911 | A | 5/1999 |
| JP | 3112490 | B2 | 11/2000 |
| JP | 2001-289167 | A | 10/2001 |
| JP | 2002-332963 | A | 11/2002 |
| JP | 2011-38476 | A | 2/2011 |
| JP | 2011-64078 | A | 3/2011 |
| JP | 2011-226368 | A | 11/2011 |

* cited by examiner (a)

(b)

(c)

TWO-SHAFT ROTARY PUMP WITH ESCAPE HOLES

FIELD OF TECHNOLOGY

The present invention relates to a two-shaft rotary pump, in which two rotating shafts provided with rotors are supported by bearings, such that the two rotors are rotated in a noncontact manner with a small clearance kept therebetween and the two rotors are rotated in a noncontact manner with a small clearance between an inner surface of a cylinder and the two rotors, and a gas sucked into the cylinder and compressed is discharged from the cylinder

BACKGROUND TECHNOLOGY

A noncontact type vacuum pump equipped with claw rotors is an example of a two-shaft rotary pump. For example, in an exhaust structure of a claw pump and a method of exhausting a gas which were proposed by the applicant of the present application, the pump comprises: a cylinder forming a pump chamber; one side plate and the other side plate covering end faces of the cylinder; two rotating shafts being arranged in parallel in the cylinder, the rotating shafts being rotated in opposite directions; two rotors being respectively integrated with the two rotating shafts, the rotors having hook-shaped claws just as meshed with each other in a noncontact manner, so as to compress a sucked gas; a rotary drive unit; a gas inlet being communicated to a part of the pump chamber where the gas in the cylinder is not compressed; and gas outlets being provided in the both side plates and opened in a part of the pump chamber where the gas in the cylinder is compressed (see Patent Document 1). With this structure, gas exhausting efficiency and function of the claw pump can be improved.

In case that a conventional two-shaft rotary pump, e.g., claw pump, is applied to a multistage pump, both ends of a rotating shaft, on which a plurality of rotors are arranged in the axial direction, are supported by bearings in a manner such that the rotors are sandwiched between two bearings (see Patent Document 2). With this structure, compression ratio of a gas can be increased by using a plurality of the rotors (multistage rotors) and the multistage cylinders, but heat is generated in each of the multistage cylinders by compressing the gas, so each of the rotors thermally expands. Further, by providing the multistage rotors to the one rotating shaft, side clearances between the rotors and end wall portions of the cylinders are badly influenced by total thermal expansion of the rotors. Namely, by the total thermal expansion of the rotors, it is difficult to suppress gas leakage by reducing the side clearances, so performance of the pump cannot be improved.

In the claw pump, the sucked gas (air) is compressed, in a compressing step, so as to improve gas exhausting efficiency. While ultimate operation of the rotary pump, no air is sucked and the pump theoretically conveys and compresses no air, so a workload of the pump is zero. However, even in the ultimate operation, air leaking from a small gap is sucked, and a non-opened space (a closed space) has negative pressure, when the non-opened space formed by the rotor and the cylinder is communicated to the outside (a space whose pressure is higher than pressure of air discharged from the pump) via the gas outlet, so the exhaust air flows backward into the pump. The air which has flown backward into the pump is recompressed and discharged to the outside again. Namely, an unnecessary process is performed, so a power load must be enlarged and temperature in the pump must be increased. Note that, the ultimate operation is operation at ultimate pressure, and the ultimate pressure is a pressure generated by the pump, in a state where a gas inlet of a vacuum pump is closed (amount of the exhaust air is zero), with the maximum capability for producing a vacuum condition.

Namely, the power load of the pump is enlarged and operating efficiency thereof is lowered by the exhaust air flowing backward into the pump while the ultimate operation, etc. By the exhaust air flowing backward, the temperature in the pump is increased, so contact of the rotors and deterioration of important parts, e.g., oil seal, bearing, are caused by the thermal expansion, so reliability of the pump must be lowered. Thus, by merely reducing the compressed space capacity immediately before exhaust opening so as to suppress the amount of the air flowing backward, a side opened to the air, in which an amount of the exhaust air is large (in case that the pressure of the sucked air is close to atmospheric pressure), is excessively compressed. Further, reduction of a flow amount will be occurred by reduction of the capacity of the pump. Note that, the backward flow of the gas is sure to be occurred as far as the capacity immediately before exhaust opening exists, so there is a problem that the above described problems must be reasonably de-escalated. Conventionally, the problems have been solved by imposing a prescribed restriction on operating conditions, so it is difficult to improve operating efficiency.

Note that, the applicant of the present application has proposed a rotary type vacuum pump having vanes (vane pump). The vacuum pump has a gas outlet, and a first check valve is provided in the gas outlet. Further, a pressure escape hole for making the compressed gas in the vacuum pump, whose pressure is higher than the outside air pressure, escape to the outside air and reducing a power loss of the vacuum pump is formed, and a second check valve is provided to the escape hole. The gas outlet and the escape hole constitute a gas discharge hole of the vacuum pump (see Patent Document 3).

With this structure, the escape hole is formed in a circumferential wall portion of wall portions constituting the cylinder, so that temperature rise can be suppressed even if excessive compression occurs in the pump.

PRIOR ART DOCUMENT

Patent Document

Patent Document 1: Japanese Laid-open Patent Publication No. 2011-38476 (see page 1)

Patent Document 2: Japanese Laid-open Patent Publication No. 2002-332963 (see FIG. 1)

Patent Document 3: Japanese Laid-open Patent Publication No. 2001-289167 (see a paragraph [0020])

SUMMARY OF THE INVENTION

Problems to be Solved by the Invention

In the above described two-shaft rotary pump, there is a problem that means for preventing an exhaust gas from flowing backward into the pump as much as possible, means for suppressing temperature rise in the pump by improving operation efficiency and means for preventing the interior of the pump from being excessively compressed have not been proposed.

An object of the present invention is to provide a two-shaft rotary pump which is capable of improving reliability and operation efficiency by preventing an exhaust gas from flowing backward into a pump as much as possible, preventing the interior of the pump form being excessively compressed as much as possible, and suppressing temperature rise in the pump.

Further, in the above described two-shaft rotary pump in which a plurality of the rotors are provided in the axial direction of the rotating shafts, the thermal expansions of the rotors are summed, so it is difficult to reduce side clearances, suppress gas leakage and improve performance of the pump.

Thus, another object of the present invention is to provide a two-shaft rotary pump, in which a plurality of the rotors are provided in the axial direction of the rotating shafts and which is capable of avoiding the bad influence of summing thermal expansions of the rotors, reducing the side clearances and suppressing the gas leakage.

Means for Solving the Problems

To achieve the objects, the present invention has following structures.

In one example of the two-shaft rotary pump of the present invention, two rotating shafts provided with rotors are supported by bearings, such that the two rotors are rotated in a noncontact manner with a small clearance kept therebetween and the two rotors are rotated in a noncontact manner with a small clearance between an inner surface of a cylinder and the two rotors, and a gas sucked into the cylinder and compressed is discharged from the cylinder; and an escape hole capable of letting a part of the compressed gas escape is provided in at least one of end wall portions constituting both ends of the cylinder and opened in the axial direction of the rotating shafts.

In one example of the two-shaft rotary pump of the present invention, two rotating shafts provided with rotors are supported by bearings, such that the two rotors are rotated in a noncontact manner with a small clearance kept therebetween and the two rotors are rotated in a noncontact manner with a small clearance between an inner surface of a cylinder and the two rotors, and a gas sucked into the cylinder and compressed is discharged from the cylinder; a plurality of pump units, each of which is constituted by the cylinder and the two rotors, are arranged in the axial direction of the two rotating shafts; at least one of the pump units is constituted by providing the bearings to the two rotating shafts, on the both sides of the rotors, so as to support both ends; and in at least one of the pump units provided to axial end faces of the rotating shafts, the two rotating shafts are supported, in a form of a cantilever, by the bearings, which are provided between one side of the rotors and the adjacent pump unit.

In one example of the two-shaft rotary pump of the present invention, the pump unit, which has the rotors provided to the two rotating shafts and is supported in the form of a cantilever, is a final stage pump unit for compressing the gas at the highest pressure.

In one example of the two-shaft rotary pump of the present invention, at least one of the pump units has an escape hole, which is capable of letting a part of the compressed gas escape and which is provided in at least one of axial end wall portions constituting both ends of the cylinder and opened in the axial direction of the rotating shafts.

In one example of the two-shaft rotary pump of the present invention, an escape hole, which is capable of letting a part of the compressed gas escape, is provided in a path-wall portion of a connection path, which connects a gas outlet of the pump unit for a first stage of the gas flow to a gas inlet of the pump unit for a latter part thereof.

In one example of the two-shaft rotary pump of the present invention, at least one of the pump units has an escape hole, which is capable of letting a part of the compressed gas escape and which is provided in a circumferential wall portion constituting a cylindrical portion of the cylinder.

In one example of the two-shaft rotary pump of the present invention, a plurality of escape holes, which are capable of letting a part of the compressed gas escape, are provided in a wall portion of the cylinder, which constitutes a compressed space in a step of compressing the gas; and a plurality of the escape holes are provided in a manner such that a rate of a total opened area of the escape holes facing the cylinder, with respect to a capacity of the compressed space which is gradually reduced according to increase of a compression ratio during the compressing step is gradually increased during the compressing step.

In one example of the two-shaft rotary pump of the present invention, pump units, each of which is constituted by the cylinder and the two rotors, are provided to both ends of each of the rotating shafts; and the two rotors of each of the pump units are supported, by bearings which are provided on one axial side of the rotating shafts and between the pump units, in a form of a cantilever through the rotating shafts.

In one example of the two-shaft rotary pump of the present invention, an escape hole, which is capable of letting a part of the compressed gas escape and opened in the axial direction of the rotating shafts, is provided in one of the end wall portions constituting axial both ends of the cylinder of at least one of the pump units provided to the both ends of the rotating shafts, the one of the end wall portions is located on the cantilever free end face-side, and no rotating shafts are penetrated therethrough.

In one example of the two-shaft rotary pump of the present invention, a plurality of the escape holes are provided.

In one example of the two-shaft rotary pump of the present invention, a check valve, which opens when an inner pressure of the cylinder is higher than a prescribed pressure and closes when the inner pressure of the cylinder is lower than the prescribed pressure, is provided to the escape hole.

In one example of the two-shaft rotary pump of the present invention, the check valve is a reed valve.

In one example of the two-shaft rotary pump of the present invention, the rotary pump further comprises a silencer section forming a silencing space, in which an exhaust gas compressed in the cylinder and discharged from the gas outlet and the exhaust gas discharged from the escape hole are combined and muffled.

In one example of the two-shaft rotary pump of the present invention, the rotor has hook-shaped claws and is used in a claw pump, and a gas outlet for discharging the gas compressed in the cylinder is provided in the end wall portion in which the escape hole is provided.

In one example of the two-shaft rotary pump of the present invention, an escape hole, which is capable of letting a part of the compressed gas escape, is provided in a circumferential wall portion of the cylinder, which constitutes a cylindrical portion thereof.

Effects of the Invention

The one example of the two-shaft rotary pump of the present invention is capable of improving reliability and operation efficiency by preventing an exhaust gas from flowing backward into a pump as much as possible, preventing the interior of the pump form being excessively compressed as much as possible, and suppressing temperature rise in the pump.

Another example of the two-shaft rotary pump of the present invention, in which a plurality of the rotors are provided in the axial direction of the rotating shafts, is capable of avoiding the bad influence of summing thermal expansions of the rotors, reducing the side clearances and suppressing the gas leakage, so that pump performance can be improved.

EMBODIMENTS OF THE INVENTION

Figure 1:
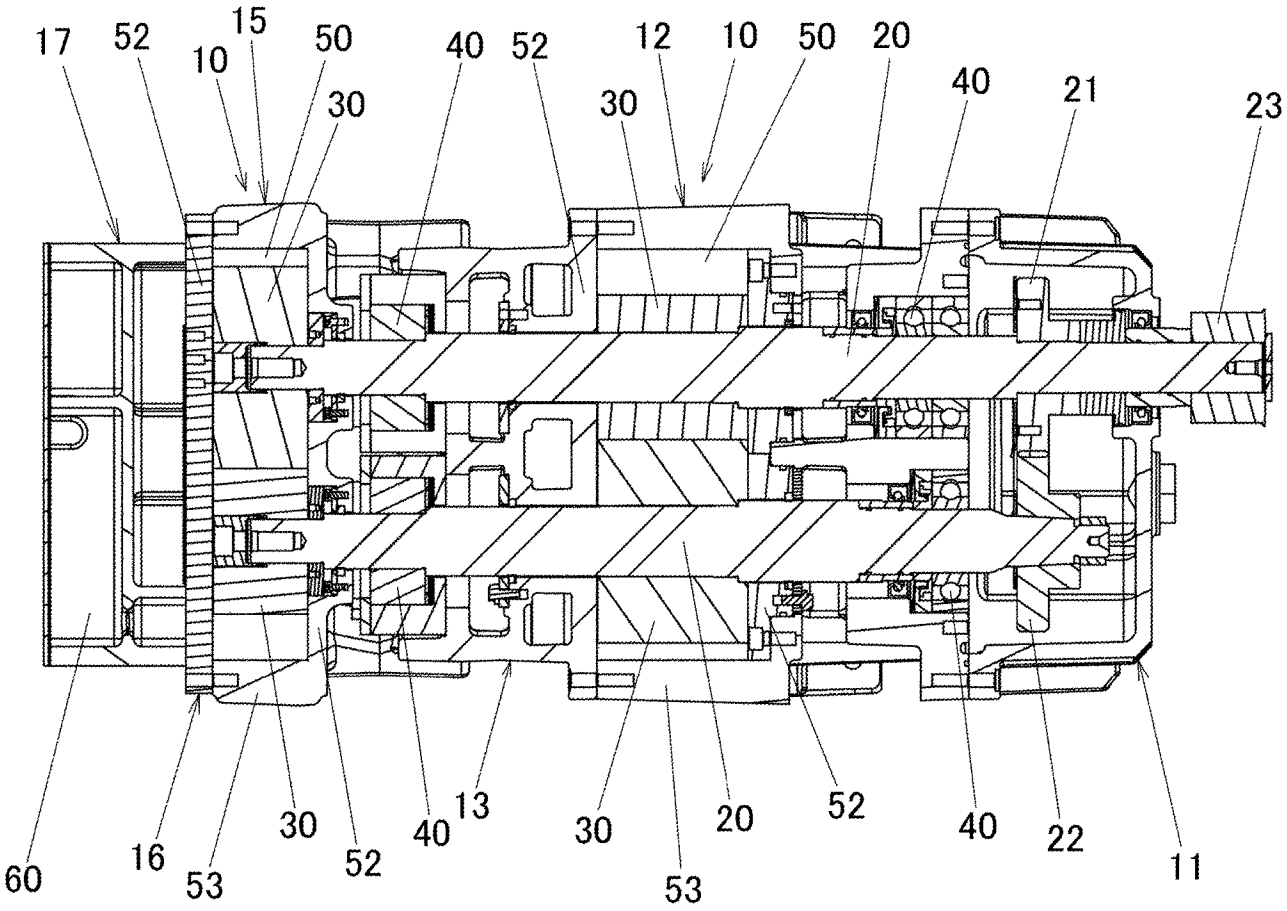
FIG. 1 It is a sectional view of an embodiment of the rotary pump relating to the present invention as a generic concept.

Embodiments of the present invention will now be explained with reference to the attached drawings. FIG. 1 is a sectional view, which shows an embodiment of the rotary pump relating to the present invention, as a generic concept, with symbols, and the generic concept of the present invention will be firstly explained with reference to FIG. 1.

Note that, the rotary pump of the present embodiment is a displacement pump belonging to a two-shaft rotary pump. Two-shaft rotary pumps include, for example, a claw pump of a rotor contactless type pump, a screw pump, a roots pump, etc. One-shaft rotary pumps include, for example, a vane pump, etc. Each of the rotary pumps is actuated by, for example, an electric motor and used as a pneumatic device, e.g., a vacuum pump, a blower.

In the two-shaft rotary pump of the present embodiment, two rotating shafts 20 and 20 provided with rotors 30 and 30 are supported by bearings 40 and 40, such that the two rotors 30 and 30 are rotated in a noncontact manner with a small clearance kept therebetween and the two rotors 30 and 30 are rotated in a noncontact manner with a small clearance between an inner surface of a cylinder 50 and the two rotors, and a gas sucked into the cylinder 50 and compressed is discharged from the cylinder 50.

Figure 5:
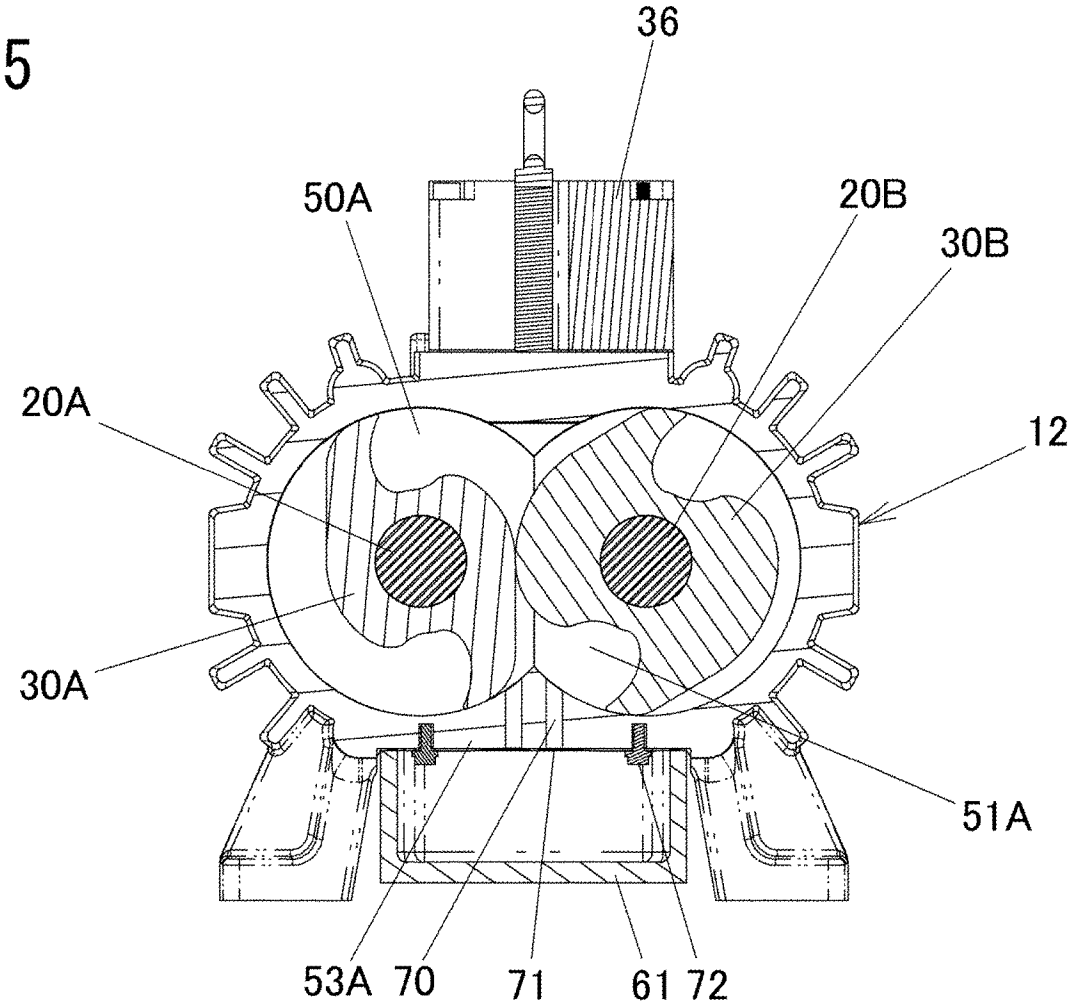
FIG. 5 It is a sectional view of the embodiment shown in FIG. 4 taken along a line X-X.
Figure 6:
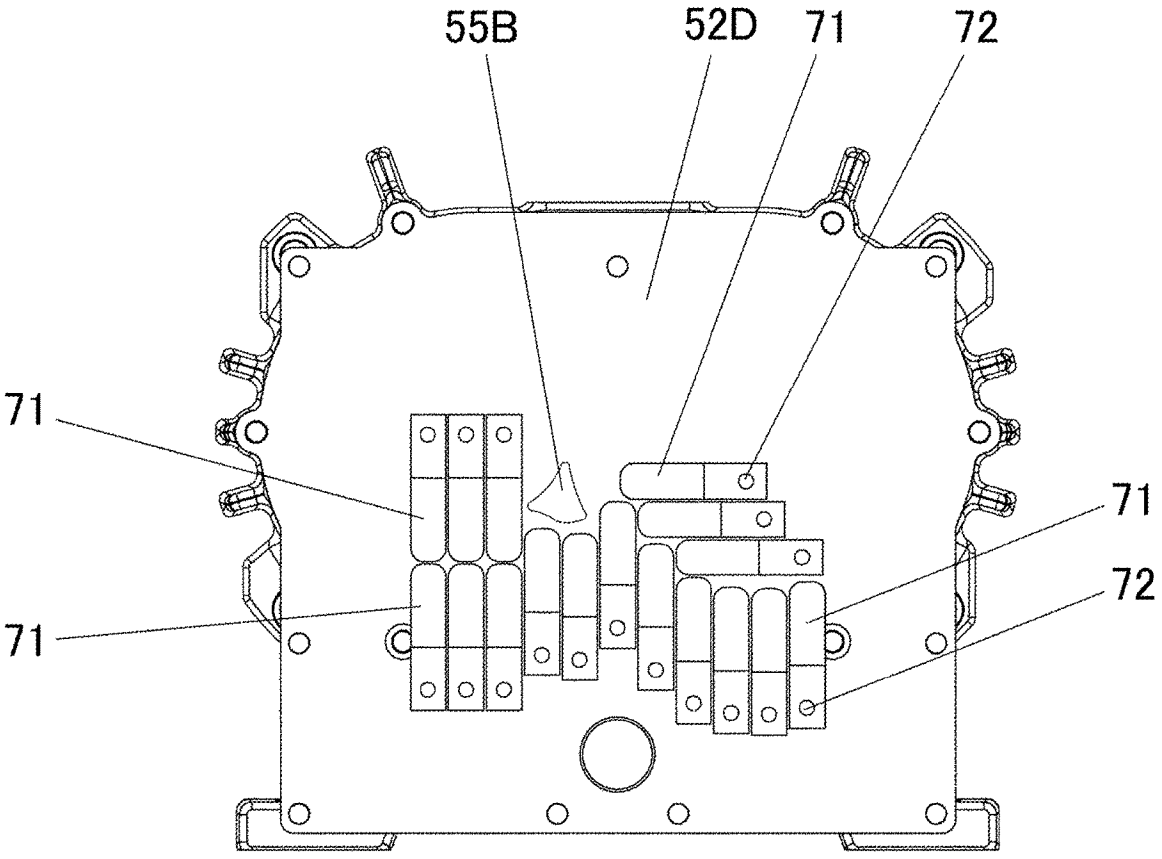
FIG. 6 It is a side view of an end wall portion shown in FIG. 2, from which a muffler case is detached.

The two-shaft rotary pump is a claw pump, and the rotors 30 and 30 have hook-shaped claws (see FIG. 5). The rotor 30 of the present embodiment has a plurality of hook-shaped claws (e.g., two claws), but the shape of the rotor is not limited to the present embodiment, so the rotor may have one claw, or three claws or more. Note that, the claw pump is capable of highly compressing the gas, so an inner temperature of the pump is easily increased.

Further, in the claw pump of the present embodiment, a plurality of pump units (e.g., two pump units) 10, each of which is constituted by a cylinder 50 and the two rotors 30 and 30, are provided on two rotating shafts 20 and 20 and arranged in an axial direction thereof, as a multistage two-shaft rotary pump.

Figure 4:
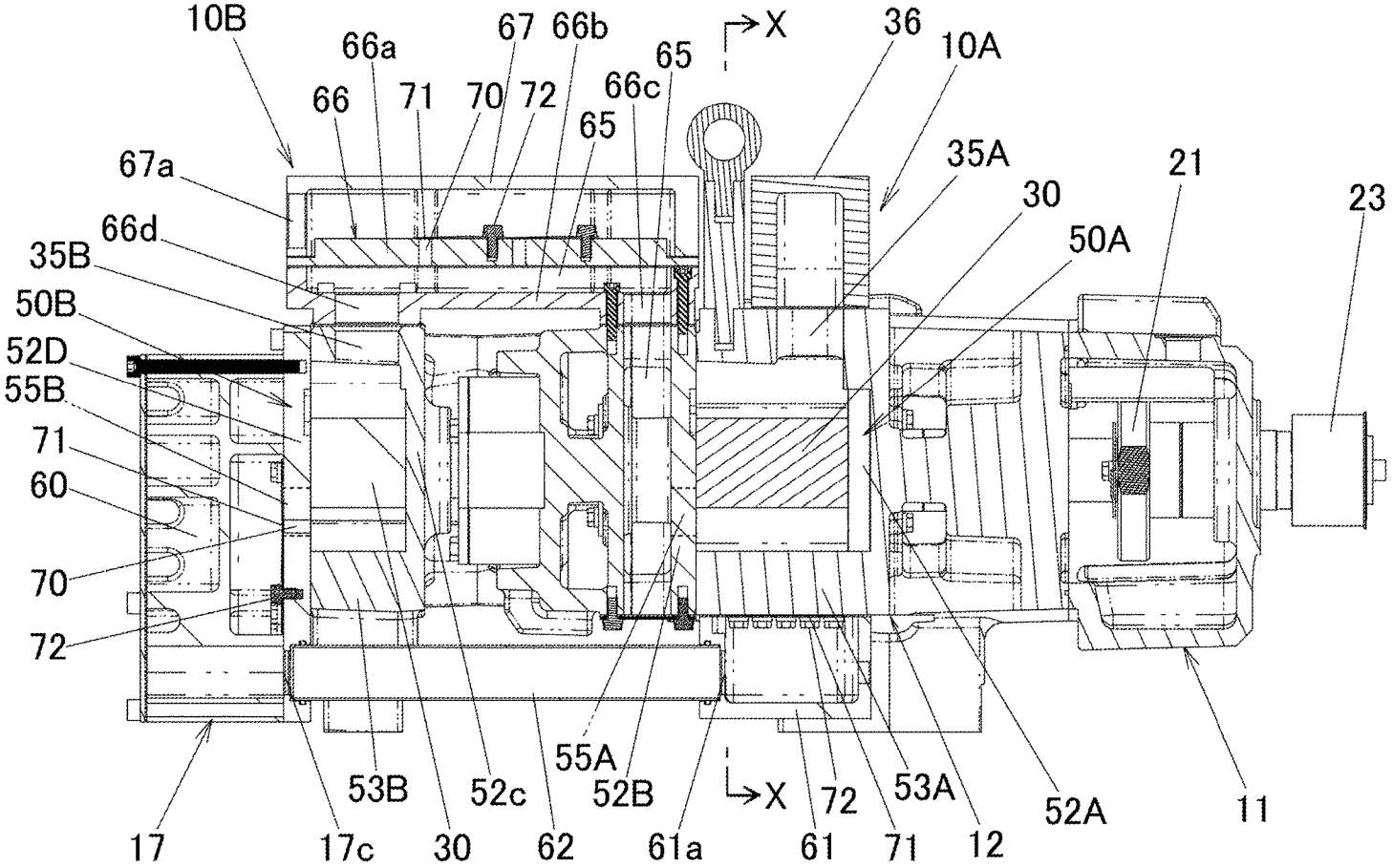
FIG. 4 It is a central longitudinal sectional view of the embodiment shown in FIG. 2.
Figure 7:
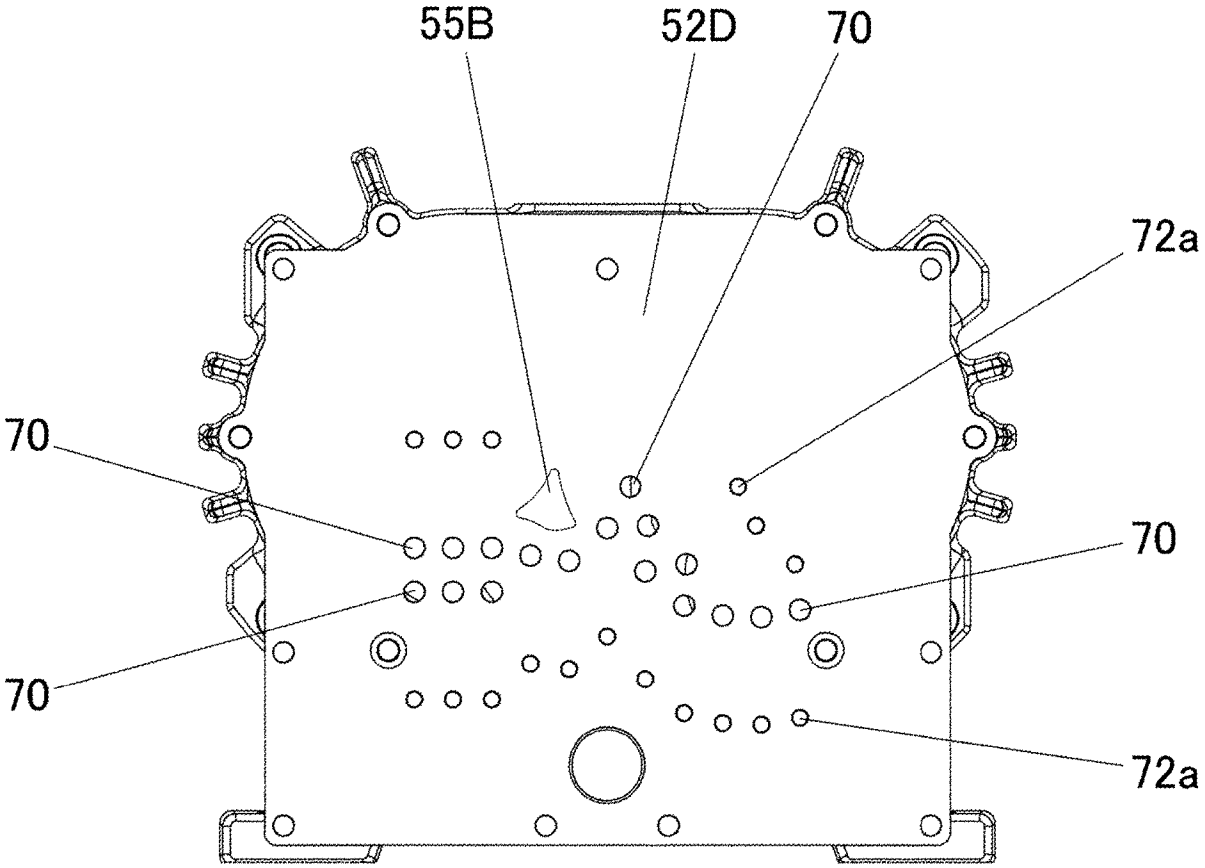
FIG. 7 It is a side view of the end wall portion shown in FIG. 6, from which a check valve is detached.
Figure 8:
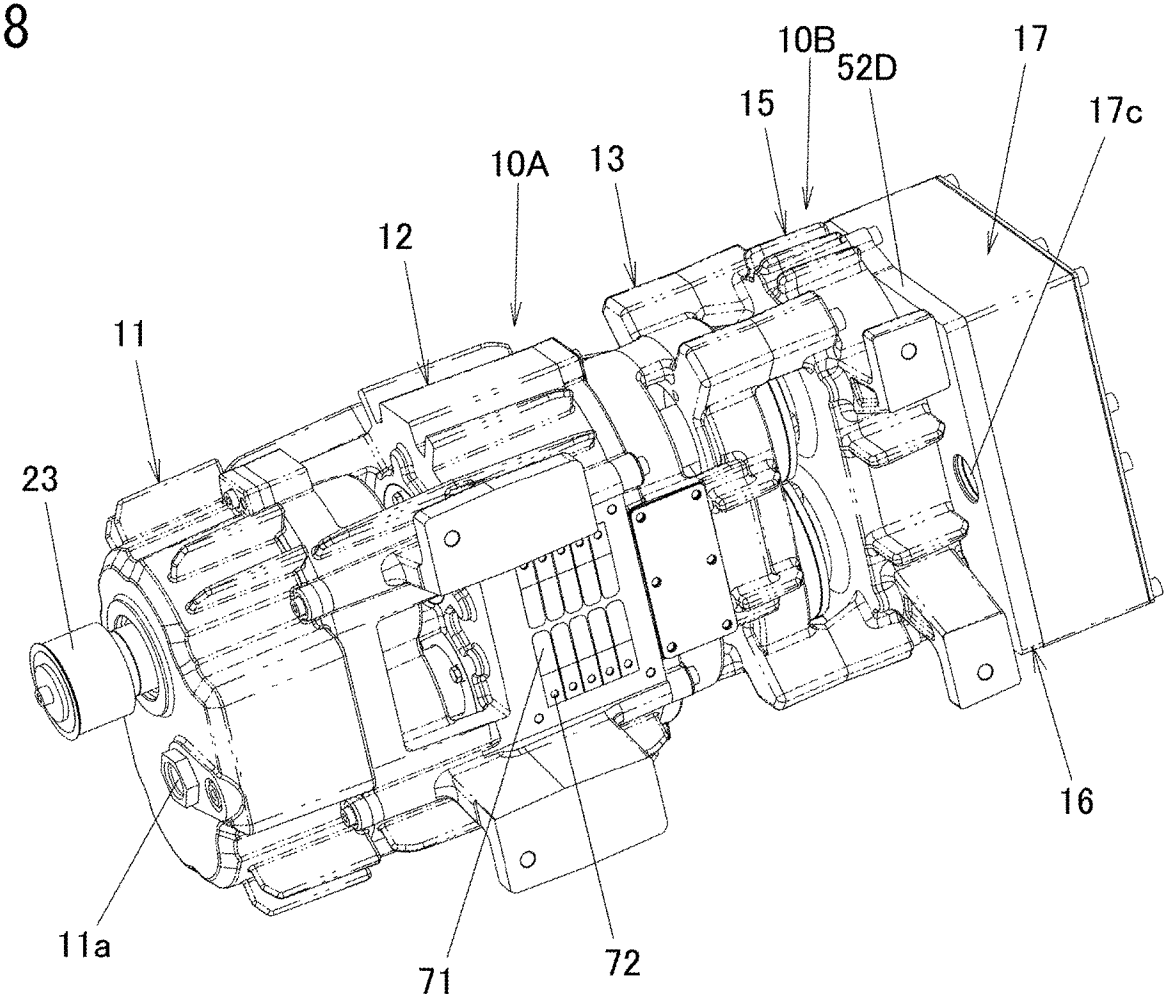
FIG. 8 It is a perspective view of the embodiment shown in FIG. 2, which is seen from a bottom side and in which an escape box is detached.
Figure 9:
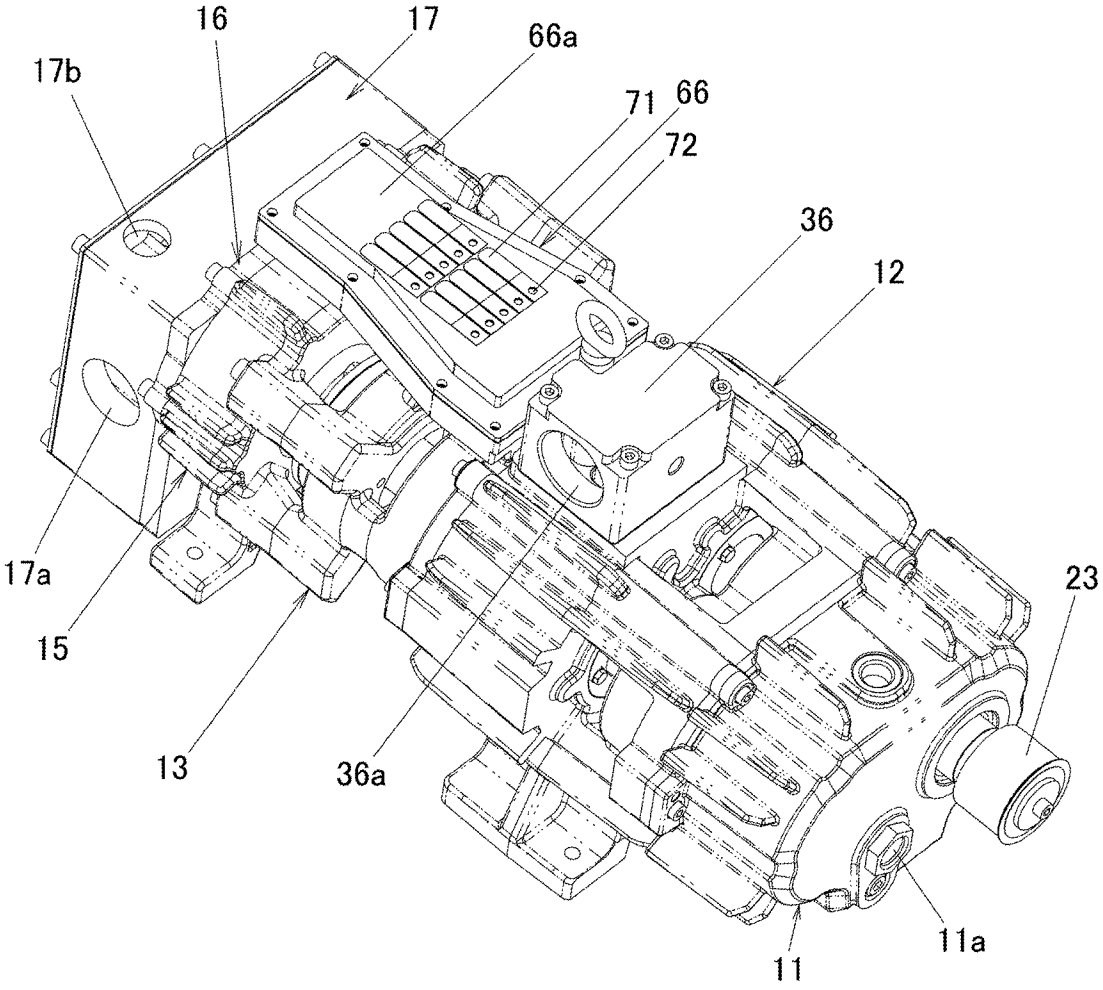
FIG. 9 It is a perspective view of the embodiment shown in FIG. 2, which is seen from an upper side and in which a cover section of a connection case is detached.

In at least one of the pump units 10, escape holes 70 (see FIGS. 4, 7, etc.) capable of letting a part of a compressed gas escape are provided in at least one of end wall portions 52 and 52 constituting both ends of the cylinder 50, and they are opened in the axial direction of the rotating shafts 20 and 20.

In the present embodiment, a plurality of the escape holes 70 (see FIGS. 4, 7, etc.) are provided in the end wall portion 52. A gas outlet (a gas outlet 55B of a latter stage, see FIGS. 4, 7, etc.) for discharging the gas compressed in the cylinder 50 is provided in the end wall portion (the other end wall portion 52D of the latter stage cylinder, see FIGS. 4, 7, etc.) in which the escape holes 70 are provided.

Note that, shapes, sizes, number, arrangement, etc. of the escape holes 70 are not limited to the present embodiment. For example, at least a part of many escape holes 70 (two or more escape holes) may be opened in a stripe groove which is formed in an inner surface of the cylinder 50, such that the escape holes 70 are communicated to the stripe groove which acts as a large hole in the inner surface of the cylinder 50. In this case too, check valves described later (reed valves 71), which respectively correspond to the escape holes 70, may be provided in an outer surface (an exhaust side surface) of the cylinder 50.

In case of the rotary pump, e.g., the contactless type vacuum pump having the claw rotors, excessive compression on a side opened to the air can be suppressed by the escape holes 70. By suppressing excessive compression, compression ratio can be increased by making the gas outlet (the gas outlet 55B of the latter stage) small, such that a compressed space capacity immediately before exhaust opening is reduced. By reducing the compressed space capacity immediately before exhaust opening, an amount of the exhaust gas flowing backward into the pump can be suppressed. By suppressing the amount of the gas flowing backward into the pump, a power load of the vacuum pump can be reduced while ultimate operation, so that energy consumption can be reduced, and temperature rise of the pump can be suppressed while ultimate operation, and so that thermal expansion can be suppressed and life spans of important parts can be extended.

Since the escape holes 70 of the end wall portion 52 are opened in the axial direction of the rotating shafts 20 and 20, the escape holes have a short length corresponding to a thickness of the end wall portion 52, and exhaust response ability as the escape holes 70 are superior. Namely, an excessively compressed gas can be successively discharged with a short time lag. Further, the escape holes 70 can be easily disposed at suitable positions in the surface of the end wall portion 52, and their functions can be suitably exhibited.

By providing a plurality of the escape holes 70 in the end wall portion 52, the excessively compressed gas can be discharge, with good balance, at a proper time, so that the function of the escape holes can be improved.

A symbol 11 stands for an oil bath cover, which constitutes an oil bath section including: a driving gear 21 integrally fixed to a rotating shaft 20A (see FIG. 3) of a driving-side; and a driven gear 22 integrally fixed to a rotating shaft 20B (see FIG. 3) of a driven-side. Note that, a symbol 11*a* stands for an oil gauge for checking an amount of a lubricant oil in the oil bath section.

A symbol 23 stands for a driven pulley, which is integrally fixed to one end of the rotating shaft 20A of the driving-side. A driving belt is engaged with the driven pulley 23, and the two-shaft rotary pump is actuated by transmitting a driving power of, for example, an electric motor. Note that, means for transmitting the driving power is not limited to the above described means, so said means may be constituted by, for example, connecting the rotating shaft 20A of the driving-side and the electric motor, which are serially arranged, with a coupler.

In the present embodiment, an outer frame is constituted by connecting the oil cover 11, a pump body 12 of a first stage, a side plate 13 of the first stage, a pump body 15 of the latter stage, a side plate 16 of the latter stage and a muffler case 17 to each other and arranged in the axial direction of the rotating shafts 20. The oil bath section constituted by the oil bath cover 11 is provided on the driven-side, the driving gear 21 and the driven gear 22 are respectively integrally fixed to rear ends of the rotating shafts 20, which are supported, by bearings 40, in a form of cantilevers.

Each of the cylinders 50, which are respectively provided to the pump body 12 of the first stage and the pump body 15 of the latter stage, is constituted by the both end wall portions 52 and a circumferential wall portion 53.

A symbol 60 stands for a silencer section, which is constituted by the muffler case 17 and which includes a silencing space in which the exhaust gas compressed in the cylinder 50 and discharged from the gas outlet (the gas outlet 55B of the latter stage, see FIGS. 4 and 7) and the exhaust gas discharged from the escape holes 70 (see FIGS. 4 and 7) are combined. With this structure, exhaust noise can be effectively muffled.

Namely, the silencer section is one muffler, in which the exhaust gasses of two ways, i.e., the normal exhaust gas being discharged from the gas outlet always opened (e.g., the gas outlet 55B of the latter stage); and the exhaust gas for preventing excessive compression being discharged from the escape holes 70 when the check valves 71 are opened, are combined to muffle noises, so the silencer section has a reasonable and inexpensive structure.

Successively, the two-shaft rotary pump relating to the present invention, which has a plurality of the pump units (two pump units), e.g., claw pump, will be concretely explained with reference to FIGS. 2-10.

Figure 3:
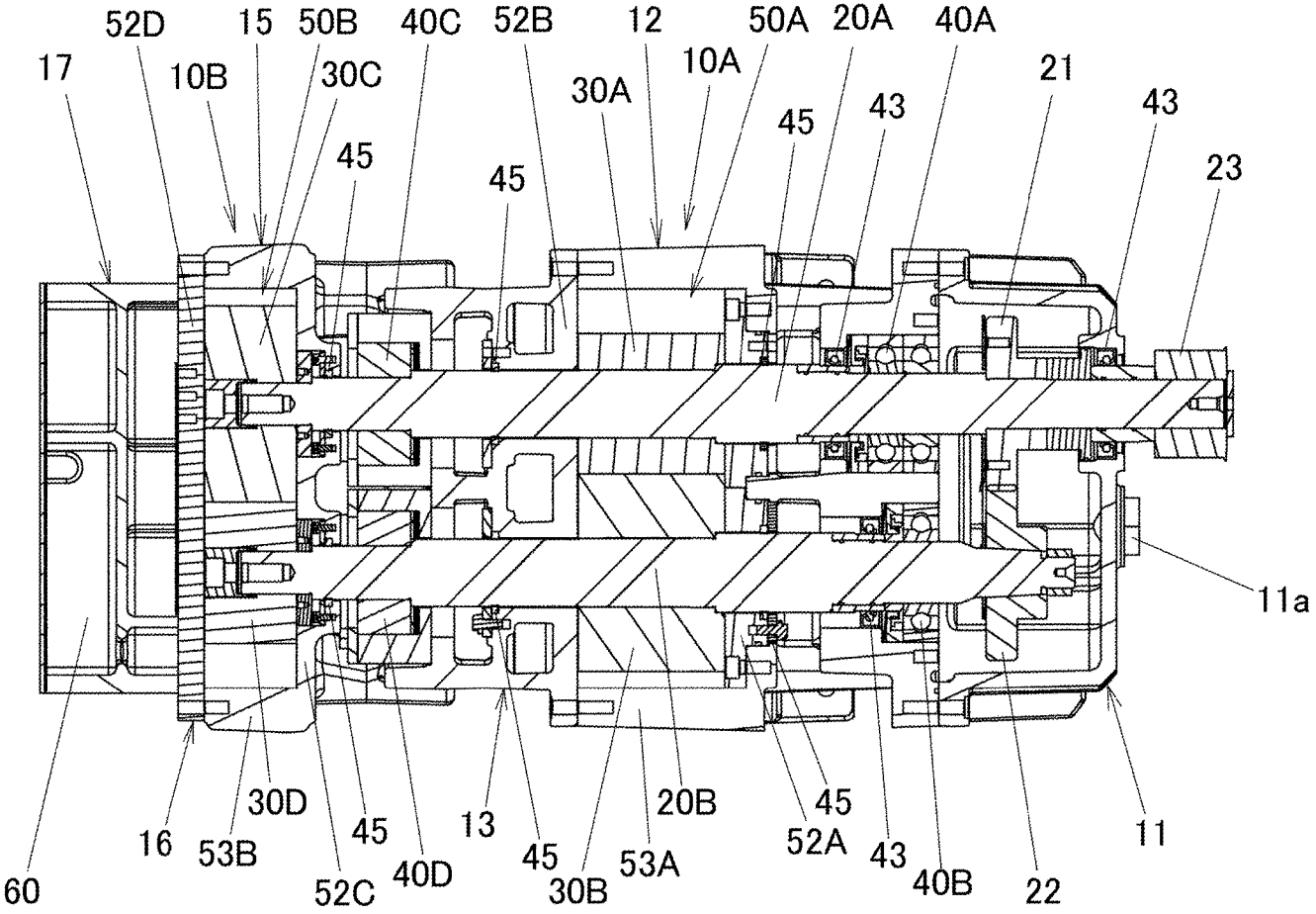
FIG. 3 It is a central transverse sectional view of the embodiment shown in FIG. 2.

In at least one of the pump units 10A and 10B (e.g., the pump unit 10A) of the present embodiment, as shown in FIG. 3, the two rotating shafts 20A and 20B, on which the rotors 30A and 30B are provided respectively, are supported by bearings 40A, 40B, 40C and 40D, which are provided on both sides of the rotors. Note that, in the present embodiment, the pump unit 10A is provided for the first stage of the gas flow, and the pump unit 10B is provided for the latter stage of the gas flow.

In at least one of the pump units 10A and 10B of the present embodiment (e.g., the pump unit 10B), which are provided to the axial end face of the rotating shafts 20A and 20B, the two rotating shafts 20A and 20B are supported by the bearings 40C and 40D, which are provided between the rotor 30C and 30D and the pump unit 10A, in the form of cantilevers. Note that, the bearings 40C and 40D may be multiple row angular ball bearings.

With this structure, the rotors 30A and 30B are disposed on one side of the bearings 40C and 40D, and the rotors 30C and 30D are disposed on the other side thereof. So, thermal expansions occur on the axial both sides of the bearings 40C and 40D. Therefore, as to the side clearances between the rotors 30 and the end wall portions 52 of the cylinder, influences of the thermal expansions are dispersed to one side including the rotors 30A and 30B and the other side including the rotors 30C and 30D. In comparison with the conventional multistage pump in which both ends of the rotating shafts equipped with rotors are supported by sandwiching the rotors with two bearings, the influences of the thermal expansions relating to the side clearances can be made small. Therefore, the side clearances can be small and gas leakage can be suppressed, so that performance of the pump can be improved.

Further, in the present embodiment, the rotors 30C and 30D, which are provided on the base end-side of the rotating shafts 20A and 20B of the final stage pump unit 10B capable of compressing the gas at the highest pressure, are supported in a form of cantilevers by the bearings 40C and 40D, which are provided between the final stage pump unit 10B and the first stage pump unit 10A, through the rotating shafts 20A and 20B Namely, the pump unit 10B, in which the rotors 30C and 30D are provided to the rotating shafts 20A and 20B and supported in the form of cantilevers, is the final stage pump unit capable of compressing the gas at the highest pressure.

In case that the pump unit 10B is the final stage pump unit, the gas of a large volume is introduced into the cylinder 50A of the first stage pump unit, so the rotors 30A and 30B of the first stage pump unit 10A have a large width and a large mass, so they are supported at the both ends. In the final stage (e.g., second stage) pump unit 10B, the compressed gas is introduced into the cylinder 50B, so the rotors 30C and 30D have a small width and a small mass and they are supported in the form of cantilevers.

In case of supporting the both ends, a load is dispersed and the structure is suitable for supporting the large mass rotors, i.e., the rotors 30A and 30B of the first stage. On the other hand, in case of supporting in the form of cantilevers, the supporting structure is not suitable for supporting the large mass rotors, but suitable for supporting the small mass rotors, i.e., the rotors 30C and 30D of the final stage. Therefore, the multistage pump of the present embodiment can be constituted reasonably.

Further, in the present embodiment, the escape holes 70 (see FIGS. 4, 7, etc.), which are capable of letting a part of the compressed gas escape, are formed in the end wall portion 52D on the cantilever free end face-side, through which no rotating shafts 20A and 20B are penetrated and which constitutes one of the end portions 52C and 52D of the cylinder 50B of the final stage pump unit 10B, and opened in the axial direction of the rotating shafts 20A and 20B.

By forming the escape holes 70, even if the gas outlet is made small due to capacity reduction immediately before exhaust opening, excessive compression on the side opened to the air can be suppressed. Therefore, the escape hole 70 is an example of a structural element of a mechanism for preventing excessive compression on the side opened to the air.

Further, the rotating shafts 20A and 20B are not penetrated through the end wall portion 52D, and there are almost no restrictions against forming the escape holes 70 in the end wall portion 52D, so that the escape holes 70 can be easily and suitably formed at prescribed positions. Therefore, performance of the pump can be improved.

Namely, in case of the conventional pump in which the rotating shafts 20A and 20B (shafts) are penetrated through the side plates to support the both ends of the shafts, the escape holes 70 can be provided, but the check valves 71 cannot be disposed at suitable positions because of being interfered with the shafts. On the other hand, in case that the shafts are supported, in the form of cantilevers, without penetrating the side plate, the check valves 71 can be suitably disposed without being interfered. Note that, in case of employing the multistage pump units, the final stage pump unit may be supported in the form of a cantilever without penetrating the shafts through the side plate.

The check valves 71 (see FIGS. 4, 6, etc.), which open when inner pressures of the cylinders 50A and 50B are higher than a prescribed pressure and which close when the inner pressures thereof are lower than the prescribed pressure, are provided to the escape holes 70. The check valves 71 prevent the exhaust gas from flowing backward into the cylinders of a high vacuum state, via the escape holes 70, as a backward flow suppression mechanism. By preventing the exhaust gas from flowing backward into the cylinders of the high vacuum state as much as possible, performance of the pump can be improved.

The check valves of the present embodiment are reed valves 71. Each of the reed valves 71 is formed into a strip shape, whose rear base end is fixed and supported in a form of a cantilever and whose free front end is formed round and capable of opening and closing the escape hole 70. The reed valve 71 is fixed by a fixing bolt 72 which is screwed in a bolt hole 72*a*. The reed valve 71 is the check valve fixed on the exhaust-side of the escape hole 70 and opened when a pressure difference between a pressure on the exhaust-side and a pressure in a compression space exceeds a spring force (elastic force) of the reed valve. The reed valve 71, which acts as the check valve, has a simple and compact structure, can be inexpensively produced and can be easily attached, and maintenance of the reed valve can be easily performed. Note that, the check valves are not limited to the reed valves 71 of the present embodiment, so valves produced by elastic materials, e.g., rubber, silicone, or valves opened and closed by elasticity of elastic members (e.g., springs) may be employed.

The above described structure may be applied to a one-shaft rotary pump having one pump unit. Namely, the above described structure can be applied to a rotary pump, in which the rotor 30 is rotated in the cylinder 50 provided to the base end of the rotating shaft 20 supported in the form of a cantilever, the rotor 30 is supported, by the bearing 40 provided on one side, in the form of a cantilever, through the rotating shaft 20, and the gas sucked and compressed in the cylinder 50 is discharged from the cylinder 50.

In this case too, the escape holes 70, which are capable of letting a part of the compressed gas escape, may be formed in the end wall portion 52D on the cantilever free end face-side, through which no rotating shafts 20A and 20B are penetrated and which constitutes one of the end wall portions 52 and 52 of the cylinder 50, and opened in the axial direction of the rotating shaft 20.

The rotating shaft 20 is not penetrated through the end wall portion 52D, and there are almost no restrictions against forming the escape holes 70 in the end wall portion 52D, so that the escape holes 70 can be easily and suitably formed at prescribed positions. Therefore, performance of the pump can be improved.

Further, the above described structure can be applied to a one-shaft rotary pump having a plurality of pump units. Namely, in case that a plurality of the pump units 10, each of which includes the cylinder 50 and the rotor 30, are axially arranged on the rotating shaft 20, the above described effects can be obtained by forming the escape holes 70 in the end wall portion 52D, which is located on the cantilever free end face-side of the final stage cylinder 50B in which the gas is compressed at highest pressure.

Further, in the present embodiment, the escape holes 70, which are capable of letting a part of the compressed gas escape, are formed in the circumferential wall portion 53A (see FIG. 5) constituting the cylindrical portion of the cylinder 50A of the first stage. The gas escaped from the escape holes 70 is discharged to an escape box 61, which is provided outside of the circumferential wall portion 53A, and further discharged to the silencer section 60 via an escape pipe 62, which connects an outlet 61*a* of the escape box (see FIG. 4) to an escape pipe connection port 17*c* of the muffler case 17. Further, the exhaust gas is combined with other exhaust gases from the gas outlets 55A and 55B and muffled in the silencer section 60, and then the combined gas is discharged outside from a gas outlet 17*a* of the muffler case (see FIG. 2).

By the escape holes 70 formed in the circumferential wall portion 53A too, excessive compression in a compression space 51A of the pump can be suppressed as described above, so that performance of the pump can be improved.

Note that, in case of forming the escape holes 70 in the circumferential wall portion 53A, a length of the escape holes is longer than that of the escape holes formed in the end wall portion 52, so exhaust response ability as the escape holes 70 is slightly lowered, we think. Further, in case of forming the escape holes 70 in the circumferential wall portion 53A, the positions of the escape holes are often limited, so there is a little problem in comparison with the case of forming the escape holes 70 in the end wall portion 52. For example, if the width of the rotors is narrow, number of the escape holes 70 must be reduced and sufficient number of the escape holes will not be secured.

In the present embodiment, the escape holes 70, which are capable of letting a part of the compressed gas escape, are provided in a path-wall portion 66*a* of a connection path 65 (see FIG. 4), which connects the gas outlet 55A of the first stage pump unit 10A to a gas inlet of the latter stage pump unit 10B (a gas inlet 35B of the latter stage). Note that, the connection path 65 is constituted by a main body portion 66 of a connection case, which includes a base portion 66*b* of having an inlet 66*c* and an outlet 66*d* and a lid plate portion constituting the path-wall portion 66*a*.

Figure 2:
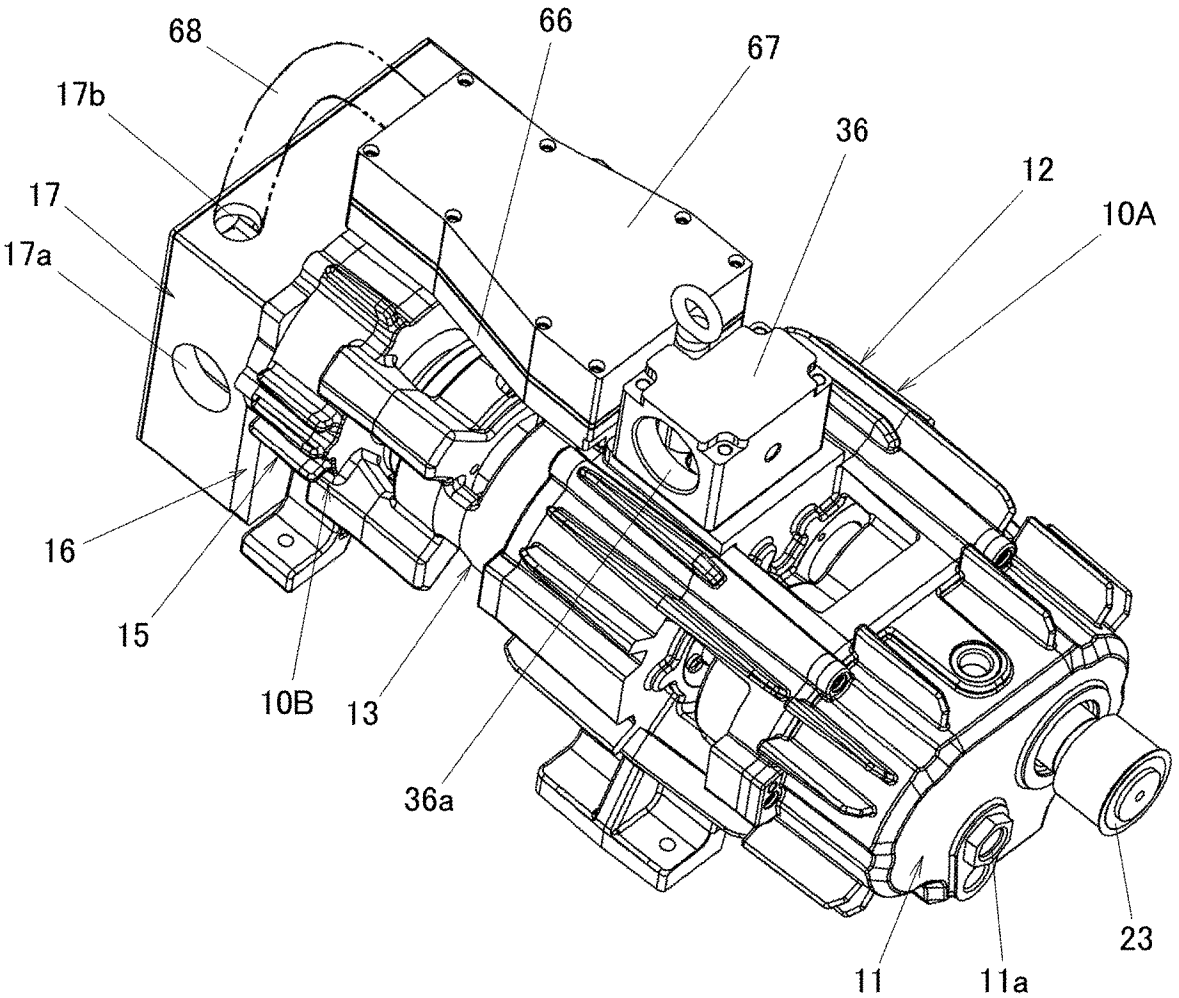
FIG. 2 It is a perspective view of the two-shaft rotary pump relating to the present invention.

The gas escaped from the escape holes 70 is discharged to a cover portion 67 of the connection case, which is fixed outside of the path-wall portion 66*a*, and further discharged to the silencer section 60 via an escape hose 68 (see FIG. 2), which connects an escape outlet 67*a* of the connection case (see FIG. 4) to an escape hose connection port 17*b* of the muffler case 17 (see FIG. 2). Further, the exhaust gas is combined with other exhaust gases form the gas outlets 55A and 55B and muffled in the silencer section 60, and then discharged outside from a gas outlet 17*a* of the muffler case.

A symbol 36 stands for a sucking case, and a symbol 36*a* stands for a gas inlet of the sucking case, which is communicated to a gas inlet 35A of the first stage pump unit 10A. A symbol 43 sands for each of oil seals, and a symbol 45 stands for each of shaft seals.

Figure 10:
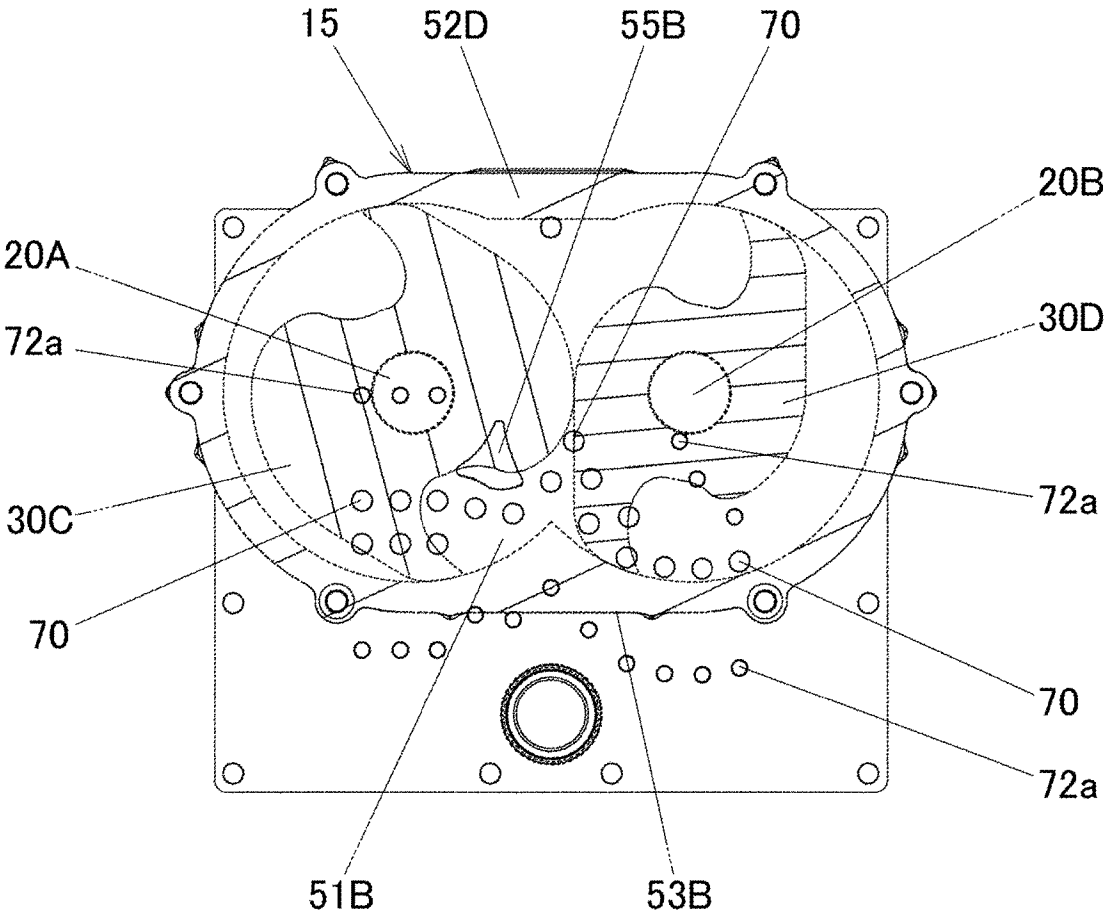
FIG. 10 It is a sectional view of the embodiment shown in FIG. 2, in which a positional relationship between two rotors and a plurality of escape holes is explained.

Next, an embodiment having a plurality of the escape holes 70 will be explained with reference to FIGS. 10 and 11. FIG. 10 shows the claw pump in a state of exhausting the gas, FIG. 11(*a*) shows the claw pump in an initial state of the step of compressing the gas, FIG. 11(*b*) shows an intermediate state of the compressing state, in which the gas outlet 55B is sufficiently closed by a side face of the rotor 30C, and FIG. 11(*c*) shows a state immediately before completing the compressing step. Arrows shown in FIG. 11 indicate rotational directions of the rotors.

In the present embodiment, a plurality of escape holes 70, which are capable of letting a part of the compressed gas escape, are formed in a part of a wall portion (a part of the other end wall portion 52D of the cylinder of the latter stage), which constitutes a part of the wall portion (i.e., the wall portion including one end wall portion 52C of the latter stage cylinder, the other end wall portion 52D thereof, and the circumferential wall portion 53B thereof) of the cylinder (the cylinder 50B of the latter stage) and which constitutes the compression space for compressing the gas. Note that, the escape holes 70 of the present embodiment are opened in the axial direction of the rotating shafts 20A and 20B.

A plurality of the escape holes 70 are disposed in a manner such that a rate of a total opened area of the escape holes 70 facing the cylinder, with respect to a capacity of the compressed space which is gradually reduced according to increase of a compression ratio during the compressing step, is gradually increased during the compressing step where the gas compression is performed in the cylinder (the cylinder 50B of the latter stage). Namely, the escape holes 70 are disposed in a manner such that a product of the compression ratio of the gas and a total opened area of the escape holes is gradually increased from the beginning of the compressing step to the termination thereof and maximized at the termination. Note that, the maximum compression ratio of the gas is the ratio of the capacity at the moment just before beginning the compression and the capacity at the moment just before beginning the discharge.

To dispose the escape holes 70 in the above described manner, an area of the escape holes 70 disposed near the gas outlet 55B may be made larger than that of the escape holes 70 disposed far from the gas outlet 55B. Therefore, in case that the escape holes having a same size (a same diameter) are disposed, number of the escape holes 70 may be increased toward the gas outlet 55B of the end wall portion 52D. Namely, density of the escape holes 70 may be made higher toward the gas outlet 55B. Further, the above described conditions can be fulfilled by making the size of the escape holes 70 larger toward the gas outlet 55B.

Note that, in the present embodiment, all of the escape holes 70 of the cylinder 50B of the latter stage are formed in the other end wall portion 52D of the cylinder of the latter stage. However, the present invention is not limited to the above described example as far as the above described conditions are fulfilled, so a part of the escape holes 70 may be provided to at least one of the end wall portions (i.e., the one end wall portion 52A of the cylinder of the first stage, the other end wall portion 52B thereof, the one end wall portion 52C of the cylinder of the latter stage, the other end wall portion 52D thereof) constituting the both ends of the cylinder (i.e., the cylinder 50A of the first stage, the cylinder 50B of the latter stage). The escape holes 70 may be provided in the circumferential wall portion 53 of the cylinder as far as a plurality of the escape holes are provided in a manner such that a rate of a total opened area of the escape holes 70 facing the cylinder, with respect to a capacity of the compressed space which is gradually reduced according to increase of a compression ratio during the compressing step, is gradually increased during the compressing step where the gas compression is performed in the cylinder 50.

The check valves 71 provided to the escape holes 70 are opened when the inner pressure of the pump reaches a positive pressure before opening the gas outlet 55B. Note that, the term "positive pressure" means that the pressure of the compression space is higher than a pressure on the exhaust side of the escape holes 70 and not limited to a pressure higher than the atmospheric pressure. When the pressure difference between the pressure on the exhaust side and that in the compression space exceeds the spring force (the elastic force) of the check valves (the reed valves 71), the reed valves 71 are opened. In the vacuum pump, the sucked air of negative pressure is compressed by the claw-shaped rotors, the check valves 71 are opened at the positive pressure (i.e., the pressure for actuating the check valves 71), and the gas is discharged from the escape holes 70. Therefore, the escape holes 70 must be disposed at prescribed positions, at which the inner pressure of the pump reaches the positive pressure in the compressing step of a rotating track defined by shapes of the rotors. Note that, the compression is progressed and the inner pressure is made higher toward the gas outlet, so that the check valves 71 which located closer to the gas outlet are easily actuated, and an acting time of the check valves 71 is made longer at a position where a time for performing the compressing step is longer, so that excessive compression on the side opened to the air can be highly suppressed. Further, in the present embodiment, the check valves 71 are the reed valves, so an operating pressure can be changed or adjusted by changing hardness or thickness thereof.

As described above, by optimally setting the disposing conditions of the escape holes 70 so as to suppress the excessive compression on the side opened to the air, the effect of suppressing the excessive compression on the side opened to the air can be maximally exhibited.

Further, number, diameter and shapes, e.g., existence of chamfer, of the escape holes 70 may be optionally selected.

In present embodiment, the rotary pump, e.g., the non-contact type vacuum pump equipped with the claw rotors, has an excessive compression suppressing mechanism including the escape holes 70, so the effects of the escape holes 70 will be explained in detail with focusing cascade of function.

In the excessive compression suppressing mechanism (e.g., the escape holes 70), excessive compression on the side opened to the air, where an amount of flowing the exhaust gas is large, can be suppressed (in case that the pump is operated in a state where the pressure of the sucked air is close to the atmospheric pressure), and backwardly flowing the exhaust gas into the highly vacuumed cylinder via the escape holes 70 can be suppressed by the check valves 71 closing the escape holes 70 as the backward flow suppression mechanism.

As described above, the excessive compression can be suppressed, the compression ratio can be increased by making the gas outlet small to reduce the compressed space capacity immediately before exhaust opening. By reducing the compressed space capacity immediately before exhaust opening, the amount of the exhaust gas backwardly flowing into the pump can be reduced. By reducing the amount of the exhaust gas backwardly flowing, a power load and rise of the inner temperature of the pump can be suppressed during the ultimate operation of the vacuum pump.

Namely, in the present embodiment, the amount of the exhaust gas backwardly flowing can be suppressed and the power load and temperature rise can be suppressed by reducing the compressed space capacity immediately before exhaust opening, the excessive compression on the side opened to the air can be suppressed by the excessive compression suppressing mechanism (i.e., the escape holes 70), and backwardly flowing the gas into the highly vacuumed cylinder can be suppressed, via the escape holes 70, by the backward flow suppression mechanism (i.e., the check valves 71), so that a structure of a high efficiency pump on a high vacuum range side, which is a single stage pump capable of using in a full range of pressure without reducing the flow amount, can be realized, and the structure is capable of a exhibiting the effects.

Note that, the capacity immediately before exhaust opening can be reduced by making the gas outlet small and disposing the gas outlet at a position where the air in the pump is compressed as much as possible. Namely, the gas outlet is provided so as to increase the compression ratio. Further, to suppress the amount of the gas backwardly flowing, the exhaust gas of the first stage pump unit of the multi stage pump may be drawn by the latter stage pump unit, or a check valve may be provided to the gas outlet.

In another aspect of the above described functions and effects, for increasing the compression ratio to reduce the compressed space capacity immediately before exhaust opening, the escape holes 70, which can suppress occurrence of the excessive compression on the side opened to the air where the flow amount of the exhaust gas is large, are provided as the excessive compression suppressing mechanism. Further, the check valves 71, which can suppress backwardly flowing the exhaust gas into the highly vacuumed cylinder via the escape holes 70, are provided as the backward flow suppression mechanism.

Successively, another embodiment of the two-shaft rotary pump relating to the present invention will be explained with reference to the accompanying drawings (FIGS. 12-15 and 11). Note that, in case that there are structural elements having a same name, the elements will be identified by adding identification characters, e.g., A, B, C and D, to numeric symbols so as to identify their locations, but in case of generally explaining the elements having the same name, the generic element will be identified, by the numeric symbol only, without adding the identification characters, e.g., A, B, C and D. For example, in case of generally explaining the rotation shafts, they will be written as "the rotating shafts 120"; on the other hand, in case of focusing an arrangement of the two rotating shafts, they will be written as "two rotating shafts 120A and 120B".

In the present embodiment, the rotary pump is a displacement pump belonging to the two-shaft rotary pump. The two-shaft rotary pump includes, for example, a claw pump of a rotor contactless type pump, a screw pump, a roots pump, etc. The rotary pump is actuated by, for example, an electric motor and used as a pneumatic device, e.g., a vacuum pump, a blower.

In the two-shaft rotary pump of the present embodiment, two rotating shafts 120 (120A and 120B provided with rotors 130 and 130) are supported by bearings 140 (sets of 140A-140B and 140C-140D), such that the two rotors 130 (sets of 130A-130B and 130C-130D) are rotated in a non-contact manner with a small clearance kept therebetween and the two rotors 130 and 130 are rotated in a noncontact manner with a small clearance between an inner surface of cylinders 150 (150A and 150B) and the rotors, and a gas sucked into the cylinders 150 and compressed is discharged from the cylinders 150. The gas is sucked from gas inlets 135A and 135B and discharged from gas outlets 155A and 155B.

Figure 15:
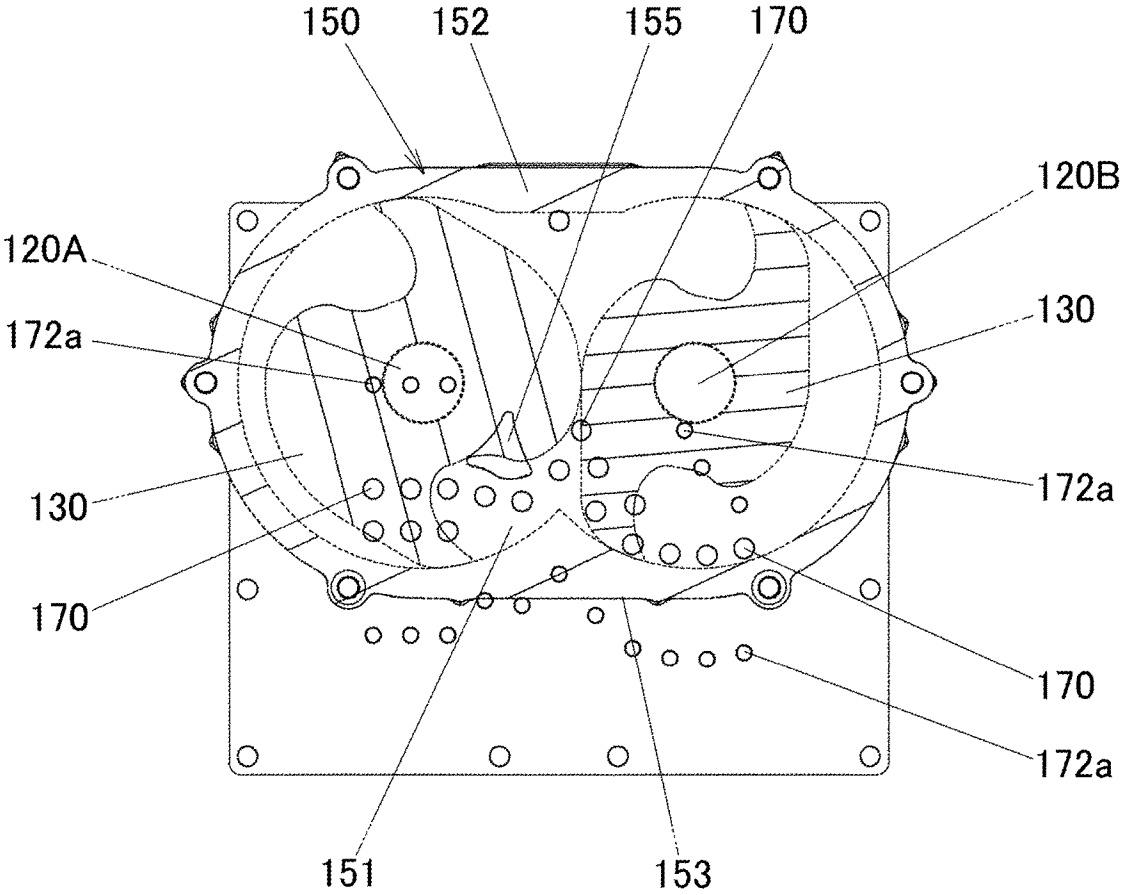
FIG. 15 It is a sectional view of the embodiment shown in FIG. 12, in which a positional relationship between two rotors and a plurality of escape holes is explained.

The two-shaft rotary pump is a claw pump, and the rotors 130 and 130 have hook-shaped claws (see FIG. 15). Note that, the claw pump is capable of highly compressing the gas, so an inner temperature of the pump is easily increased.

Further, in the claw pump of the present embodiment, a plurality of pump units (e.g., two pump units) 110 (110A and 110B), each of which is constituted by the cylinder 150 and the two rotors 130 and 130, are provided on two rotating shafts 120A and 120B and arranged in an axial direction thereof, as a multistage (e.g., two-stage) two-shaft rotary pump.

In the present embodiment, pump units 110 (110A and 110B), each of which is constituted by the cylinder 150 and the two rotors 130 and 130, are respectively provided to both ends of the rotating shafts 120; in each of the pump units 110A and 110B, the two rotors 130 and 130 are supported, on one axial side of the rotating shafts 120 (120A and 120B), by the bearings 140 (the sets of 140A-140B and 140C-140D) provided between the pump units 110A and 110B, in a form of cantilevers, through the rotating shafts 120. Note that, the bearings 140 may be multiple row angular ball bearings.

Note that, gears 121 and 122 are provided between the two bearings 140A and 140B and the two bearings 140C and 140D, and both ends of the gears 121 and 122 are supported. By engaging the gears 121 and 122 with each other, the two rotating shafts 120A and 120B are rotated in the opposite directions at a same speed.

The rotors 130A and 130B on the rotating shafts 120 are located on one side of the bearings 140 (140A, 140B, 140C and 140D), and the rotors 130C and 130D on the rotating shafts 120 are located on the other side thereof. With this structure, axial thermal expansions will separately occur on the both sides of the bearings 140 as a standard. Therefore, an influence on side clearances between axial end wall portions 152 of the cylinders and the rotors 130, which is caused by thermal expansions, is dispersed to the rotors 130A and 130B on the one side and to the rotors 130C and 130C on the other side. In comparison with the conventional multistage pump in which both ends of the rotating shafts equipped with rotors are supported by sandwiching the rotors with two bearings, the influences of the thermal expansions relating to the side clearances can be made small. Therefore, the side clearances can be small and gas leakage can be suppressed, so that performance of the pump can be improved.

Further, in the present embodiment, escape holes 170, which are capable of letting a part of the compressed gas escape, are formed in the end wall portions 152 (152A and 152D) on the cantilever free end face-sides, through which no rotating shafts 120 are penetrated and which are parts of the end portions 152 (152A, 152B, 152C and 152D) of the cylinders 150 (150A and 150B) of the both pump units 110A and 110B, and opened in the axial direction of the rotating shafts 120.

In the present embodiment, a plurality of the escape holes 170 are formed in the end wall portions 152 (152A and 152D) on the cantilever free end face-sides. Gas outlets 155 (155A and 155B) for discharging the gas compressed in the cylinders 150 (150A and 150B) are provided in the end wall portions 152 on the cantilever free end face-sides, in which the escape holes 170 are formed.

Note that, shapes, sizes, number, arrangement, etc. of the escape holes 170 are not limited to the present embodiment. For example, at least a part of many escape holes 170 (two or more escape holes) may be opened in stripe grooves which are formed in inner surfaces of the cylinders 150 (150A and 150B), such that the escape holes 170 are communicated to the stripe grooves which act as large holes in the inner surfaces of the cylinders 150. In this case too, check valves described later (reed valves 171), which respectively correspond to the escape holes 170, may be provided in outer surfaces (exhaust side surfaces) of the cylinders 150.

In case of the rotary pump, e.g., the contactless type vacuum pump having the claw rotors, the excessive compression on the side opened to the air can be suppressed by the escape holes 170. By suppressing the excessive compression, the compression ratio can be increased by making the gas outlets (155A and 155B) small, such that compressed space capacity immediately before exhaust opening is reduced. By reducing the compressed space capacity immediately before exhaust opening, an amount of the exhaust gas flowing backward into the pump can be suppressed. By suppressing the amount of the gas flowing backward into the pump, a power load of the vacuum pump can be reduced while the ultimate operation, so that energy consumption can be reduced, and temperature rise of the pump can be suppressed while the ultimate operation, and so that thermal expansion can be suppressed and life spans of important parts can be extended.

Since the escape holes 170 of the end wall portions 152 are opened in the axial direction of the rotating shafts 120, the escape holes have a short length corresponding to a thickness of the end wall portions 152, and exhaust response ability as the escape holes 170 are superior. Namely, the excessively compressed gas can be successively discharged with a short time lag. Further, the escape holes 170 can be easily disposed at suitable positions in the surfaces of the end wall portions 152, and their functions can be suitably exhibited.

By providing a plurality of the escape holes 170 in the end wall portions 152, the excessively compressed gas can be discharge, with good balance, at a proper time, so that the function of the escape holes can be improved.

Further, the rotating shafts 120A and 120B are not penetrated through the end wall portions 152A and 152D, and there are almost no restrictions against forming the escape holes 170 in the end wall portions 152A and 152D, so that the escape holes 170 can be easily and suitably formed at prescribed positions. Therefore, performance of the pump can be improved.

Namely, in case of the conventional pump in which the rotating shafts 120A and 120B (shafts) are penetrated through the side plates to support the both ends of the shafts, the escape holes 170 can be provided, but the check valves 171 cannot be disposed at suitable positions because of being interfered with the shafts. On the other hand, in case that the shafts are supported, in the form of cantilevers, without penetrating the side plates 111 and 113 (the end wall portions 152A and 152D), the check valves 171 can be suitably disposed without being interfered.

Figure 12:
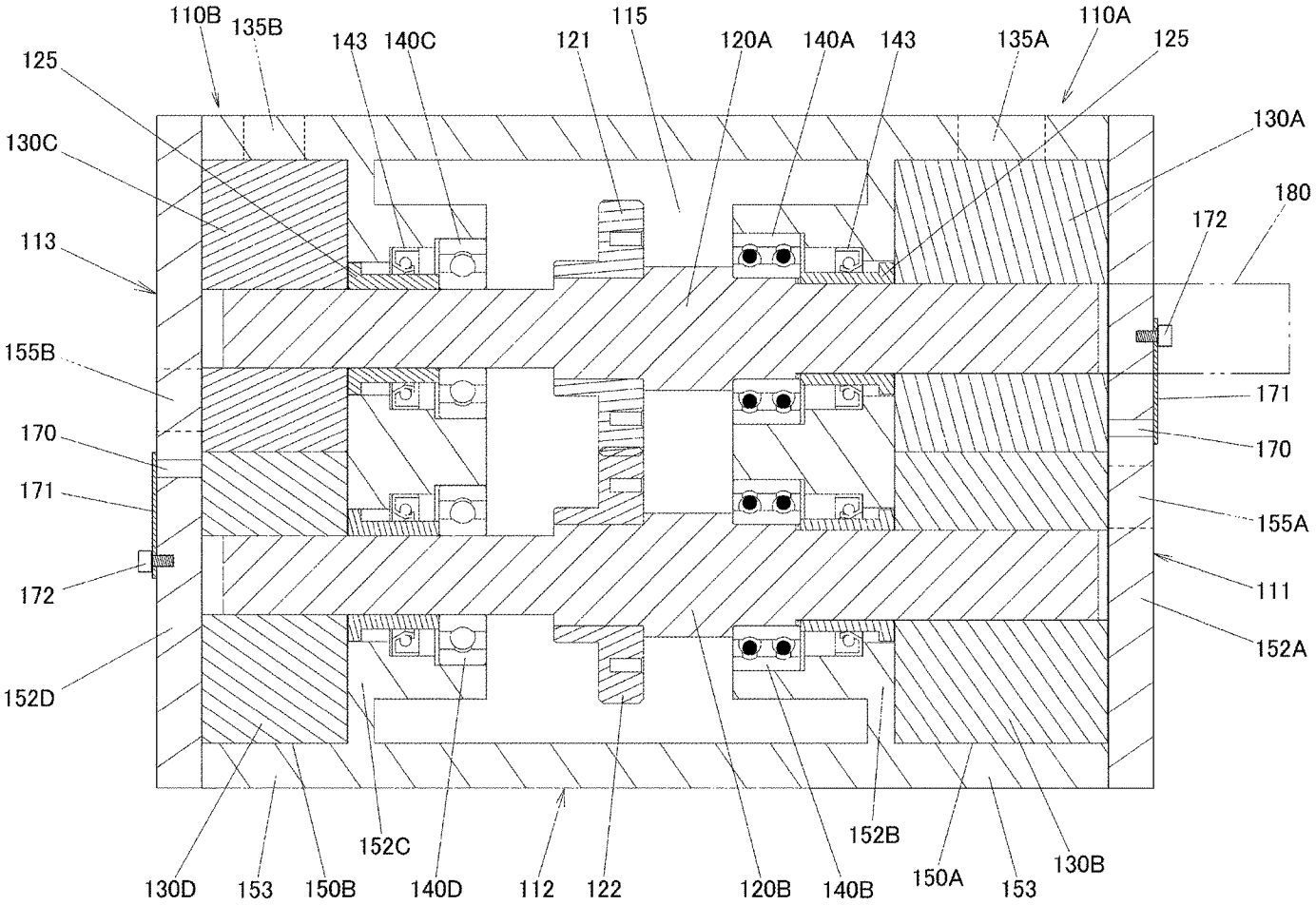
FIG. 12 It is a schematic sectional view of another embodiment of the two-shaft rotary pump of the present invention.
Figure 13:
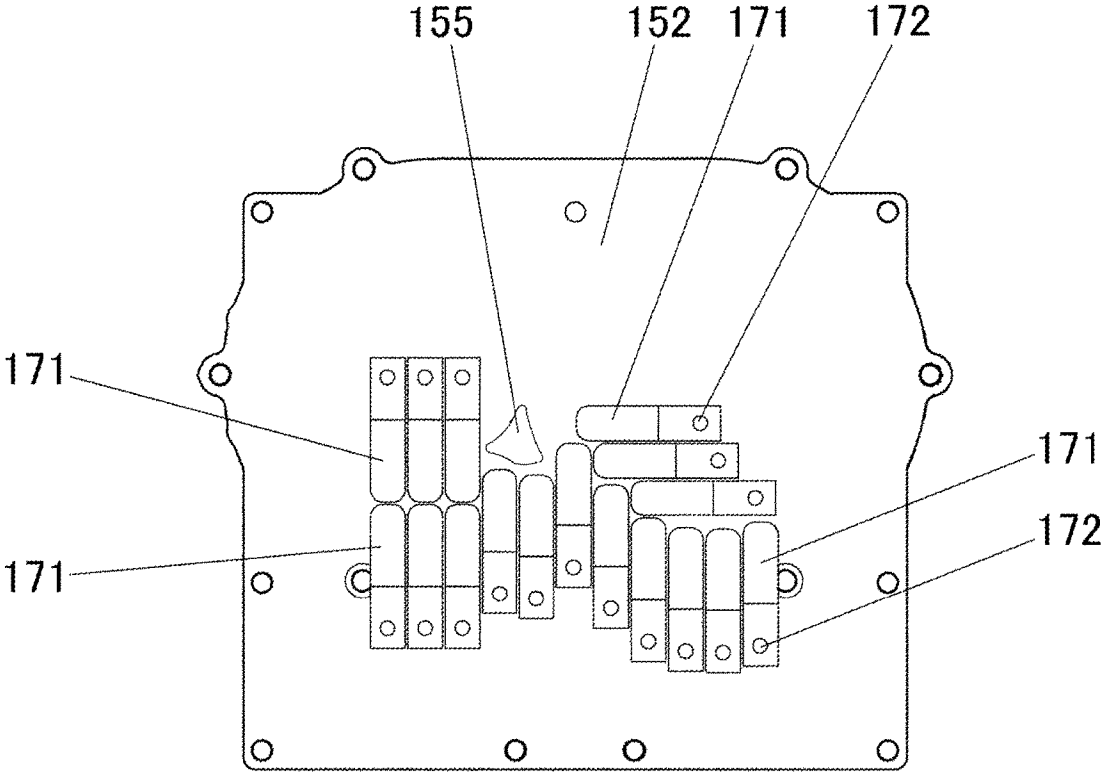
FIG. 13 It is a side view of an end wall portion of a cylinder of the embodiment shown in FIG. 12.
Figure 14:
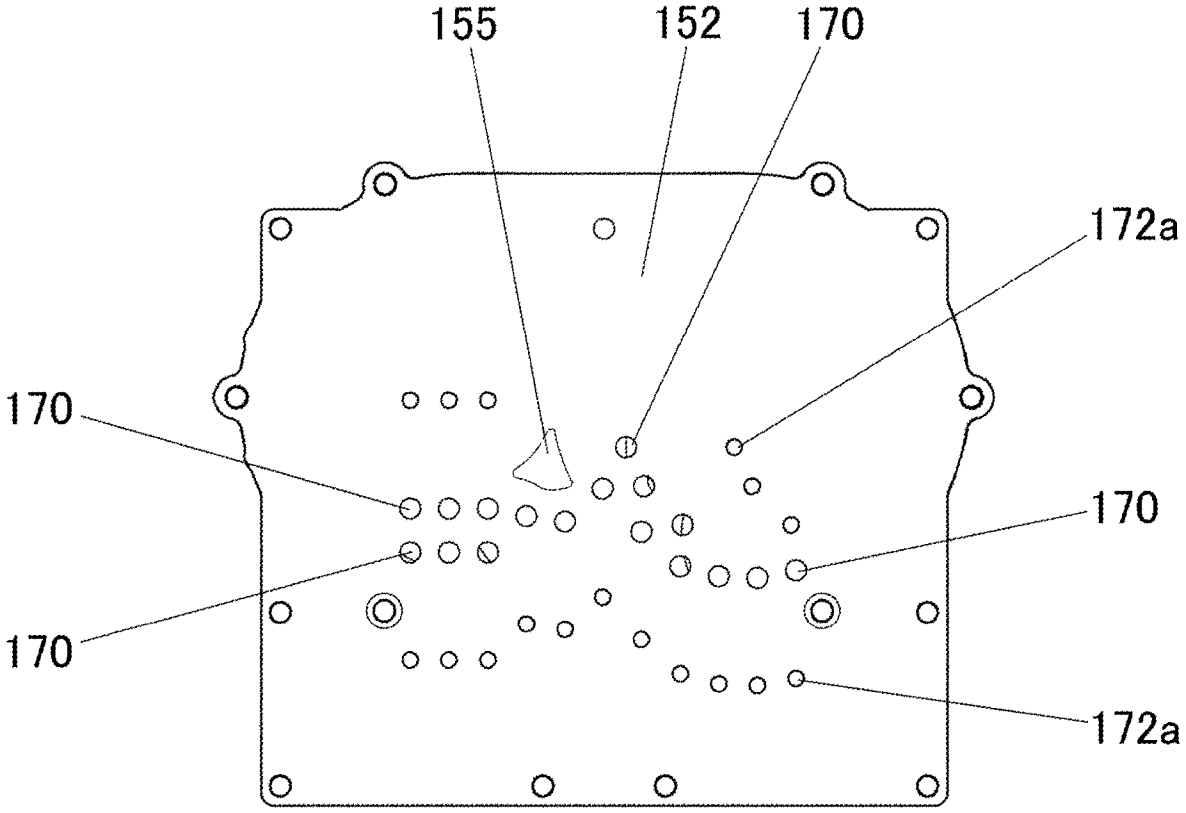
FIG. 14 It is a side view of the end wall portion shown in FIG. 13, from which a check valve is detached.

Note that, in case of connecting an extended input shaft 180, to which a driving force will be applied, as indicated by virtual lines (two-dot chain lines) shown in FIG. 12, the input shaft 180 is penetrated through the side plate 111, but the other rotating shaft 120B does not penetrate through the side plate 111. In this case too, the escape holes 170 can be disposed with less restrictions.

The check valves 171, which open when inner pressures of the cylinders 150A and 150B are higher than the prescribed pressure and which close when the inner pressures thereof are lower than the prescribed pressure, are provided to the escape holes 170. The check valves 171 prevent the exhaust gas from flowing backward into the cylinders of a high vacuum state, via the escape holes 170, as the backward flow suppression mechanism. By preventing the exhaust gas from flowing backward into the cylinders of the high vacuum state as much as possible, performance of the pump can be improved.

The check valves of the present embodiment are reed valves 171. Each of the reed valves 171 is formed into the strip shape, whose rear base end is fixed and supported in the form of a cantilever and whose free front end is formed round and capable of opening and closing the escape hole 170. Each of the reed valves 171 is fixed by a fixing bolt 172 which is screwed in a bolt hole 172*a*. Each of the reed valves 171 is the check valve fixed on the exhaust-side of each of the escape holes 170 and opened when a pressure difference between a pressure on the exhaust-side and a pressure in a compression space exceeds a spring force (elastic force) of the reed valve. Each of the reed valve 171, which acts as the check valve, has a simple and compact structure, can be inexpensively produced and can be easily attached, and maintenance of the reed valves can be easily performed. Note that, the check valves are not limited to the reed valves 171 of the present embodiment, so valves produced by elastic materials, e.g., rubber, silicone, or valves opened and closed by elasticity of elastic members (e.g., springs) may be employed.

The symbol 111 stands for the one side plate, a symbol 112 stands for a pump body, and the symbol 113 stands for the other side plate. These members are connected, in the axial direction of the rotating shafts 120, to form a housing.

Further, a symbol 115 stands for an oil bath section, which constitutes an oil chamber accommodating a driving gear 121 integrally fixed to the rotating shaft 120A and a driven gear 122 integrally fixed to the rotating shaft 120B. The oil bath section 115 is provided between one of the bearing set (140A and 140B) and the other bearing set (140C and 140D) so as to suitably lubricate. Note that, a symbol 143 stands for each of oil seals.

In the embodiment shown in FIG. 12, no driving unit is shown, so the two-shaft rotary pump of the present embodiment may be driven by, for example, transmitting a driving power of an electric motor. For example, a gear mechanism may be used as the means for transmitting the driving power. Further, in case that the rotating shaft 120A is a driving shaft and the rotating shaft 120B is a driven shaft, the transmitting means may be constituted by selecting known technologies, e.g., connecting the rotating shaft 120A and an output shaft of the electric motor, which are serially arranged, to each other, with a coupler.

In the present embodiment, one of the pump units (e.g., the pump unit 110B) may be a latter stage pump unit, which compresses the gas at the highest pressure. In case that the pump unit 110B is the latter stage pump unit, a connection path, which connects the gas outlet 155A of a first stage pump unit 110A to the gas inlet 135B of the latter stage pump unit 110B, is provided. In this case, the gas of large volume is introduced into the cylinder 150A of the first stage, so the rotors 130A and 130B of the first stage pump unit 110A may be wide and large mass rotors. On the other hand, the compressed gas is introduced into the cylinder 150B of the latter stage, so the rotors 130C and 130D of the latter stage pump unit 110B may be narrow and small mass rotors.

In the above described two-shaft rotary pump in which cantilever structures are formed on the both sides, it is easy to get access to the rotors 130, and assemblability and maintainability of the rotors, in which clearance adjustment is required, can be improved. A series of the pumps having different flow volumes can be easily produced by changing widths of the both cylinders 150 and the rotors, so that the series can be easily expanded. The reed valves 171 can be attached to the both sides of the pump, and the both pump units 110 can have high pumping performance and can be easily and inexpensively produced. Since the basic structures of the both sides are same, the pump is symmetrically formed, the entire pump can be well balanced, the pump can be suitably downsized, and a reliable and economical structure can be suitably realized. Note that, the structure of the embodiment may be variously modified without deviating the scope of the invention, for example, at least one of the both side pump units may have a multistage structure to increase the compression ratio.

Next, an embodiment having a plurality of the escape holes 170 will be explained with reference to FIGS. 15 and 11. FIG. 15 shows the claw pump in a state of exhausting the gas, FIG. 11(*a*) shows the claw pump in the initial state of the step of compressing the gas, FIG. 11(*b*) shows the intermediate state of the compressing state, in which the gas outlets 155 are sufficiently closed by the side faces of the rotors 130, and FIG. 11(*c*) shows the state immediately before completing the compressing step. The arrows shown in FIG. 11 indicate rotational directions of the rotors.

In the present embodiment, a plurality of the escape holes 170, which are capable of letting a part of the compressed gas escape, are formed in parts of the wall portions 152 and 153 of the cylinders, which constitute the compression space 151 for compressing the gas in the compressing step. Note that, the escape holes 170 of the present embodiment are opened, in the end wall portions 152, in the axial direction of the rotating shafts 120.

Figure 11:
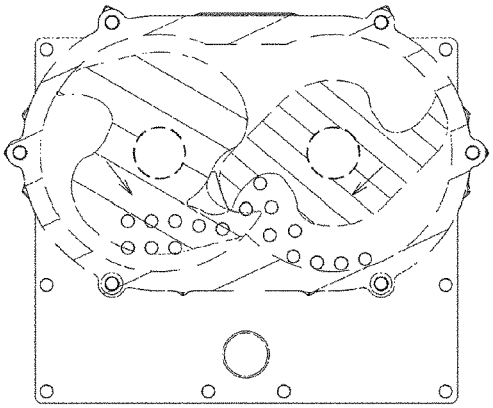
FIG. 11 It is a sectional view of the embodiment shown in FIG. 2 or 12, in which a relationship between variation of compression state of gas and openings of the escape holes.
Figure 11:
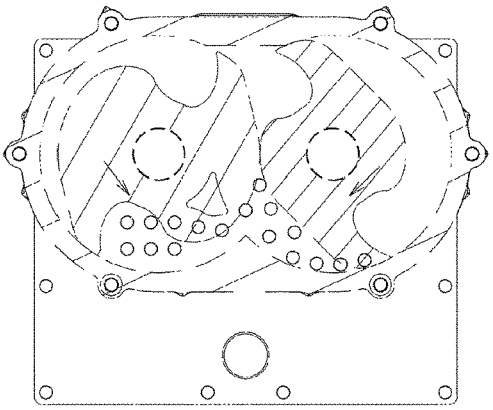
Figure 11:
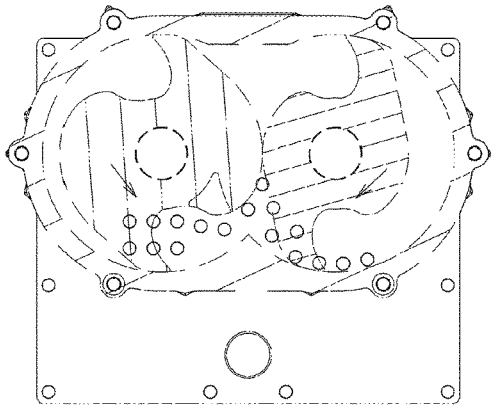

As shown in FIG. 11, a plurality of the escape holes 170 are disposed in the manner such that a rate of a total opened area of the escape holes 170, with respect to the capacity of the compressed space which is gradually reduced according to increase of the compression ratio of the compressing step, is gradually increased during the compressing step where the gas compression is performed in the cylinders 150. Namely, the escape holes 170 are disposed in a manner such that a product of the compression ratio of the gas and a total opened area of the escape holes facing the cylinder is gradually increased from the beginning of the compressing step to the termination thereof and maximized at the termination.

To dispose the escape holes 170 in the above described manner, an area of the escape holes 170 disposed near the gas outlets 155 may be made larger than that of the escape holes 170 disposed far from the gas outlets 155. Therefore, in case that the escape holes 170 having a same size (a same diameter) are disposed, number of the escape holes 170 may be increased toward the gas outlets 155 of the end wall portions 152. Namely, density of the escape holes 170 may be made higher toward the gas outlets 155. Further, the above described conditions can be fulfilled by making the size of the escape holes 170 larger toward the gas outlets 155 of the end wall portions 152.

Note that, in the present embodiment, all of the escape holes 170 of the cylinders 155 are formed in the end wall portions 152 on free end-sides of the cylinders. However, the present invention is not limited to the above described example as far as the above described conditions are fulfilled, so a part of the escape holes 170 may be provided to at least one of the end wall portions 152 constituting the both ends of the cylinders 150.

Further, the escape holes 170 may be provided in the circumferential wall portions 153 of the cylinders as far as the rate of the total opened area of the escape holes 170, with respect to the capacity of the compressed space 151 which is gradually reduced according to increase of the compression ratio of the compressing step, is gradually increased during the compressing step where the gas compression is performed in the cylinders 150.

The check valves 171 provided to the escape holes 170 are opened when the inner pressure of the pump reaches a positive pressure before opening the gas outlets 155. Note that, the term "positive pressure" means that the pressure of the compression space is higher than a pressure on the exhaust side of the escape holes 170 and not limited to a pressure higher than the atmospheric pressure. When the pressure difference between the pressure on the exhaust side and that in the compression space exceeds the spring force (the elastic force) of the check valves (the reed valves 171), the reed valves 171 are opened. In the vacuum pump, the sucked air of negative pressure is compressed by the claw-shaped rotors, the check valves 171 are opened at the positive pressure (i.e., the pressure for actuating the check valves 171), and the gas is discharged from the escape holes 170. Therefore, the escape holes 170 must be disposed at prescribed positions, at which the inner pressure of the pump reaches the positive pressure in the compressing step of a rotating track defined by shapes of the rotors. Note that, the compression is progressed and the inner pressure is made higher toward the gas outlet, so that the check valves 171 which located closer to the gas outlet are easily actuated, and an acting time of the check valves 171 is made longer at a position where a time for performing the compressing step is longer, so that the excessive compression on the side opened to the air can be highly suppressed. Further, in the present embodiment, the check valves 171 are the reed valves, so an operating pressure can be changed or adjusted by changing hardness or thickness thereof.

As described above, by optimally setting the disposing conditions of the escape holes 170 so as to suppress the excessive compression on the side opened to the air, the effect of suppressing the excessive compression on the side opened to the air can be maximally exhibited.

Further, number, diameter and shapes, e.g., existence of chamfer, of the escape holes 170 may be optionally selected.

In the present embodiment, the rotary pump, e.g., the noncontact type vacuum pump equipped with the claw rotors, has the excessive compression suppressing mechanism including the escape holes 170, so the effects of the escape holes 170 will be explained in detail with focusing cascade of function.

In the excessive compression suppressing mechanism (e.g., the escape holes 170), the excessive compression on the side opened to the air, where an amount of flowing the exhaust gas is large, can be suppressed (in case that the pump is operated in a state where the pressure of the sucked air is close to the atmospheric pressure), and backwardly flowing the exhaust gas into the highly vacuumed cylinders via the escape holes 170 can be suppressed by the check valves 171 closing the escape holes 170 as the backward flow suppression mechanism.

As described above, the excessive compression can be suppressed, and the compression ratio can be increased by making the gas outlets small to reduce the compressed space capacity immediately before exhaust opening. By reducing the capacity immediately before the exhaust opening, the amount of the exhaust gas backwardly flowing into the pump can be reduced. By reducing the amount of the exhaust gas backwardly flowing, a power load and rise of the inner temperature of the pump can be suppressed during the ultimate operation of the vacuum pump.

Namely, in the present embodiment, the amount of the exhaust gas backwardly flowing can be suppressed and the power load and the temperature rise can be suppressed by reducing the compressed space capacity immediately before the exhaust opening, the excessive compression on the side opened to the air can be suppressed by the excessive compression suppressing mechanism (i.e., the escape holes 170), and backwardly flowing the gas into the highly vacuumed cylinders via the escape holes 170 can be suppressed by the backward flow suppression mechanism (i.e., the check valves 171), so that a structure of a high efficiency pump on a high vacuum range side, which is a single stage pump capable of using in a full range of pressure without reducing the flow amount, can be realized, and the structure is capable of a exhibiting the effects more properly.

Note that, the compressed space capacity immediately before the exhaust opening can be reduced by making the gas outlets small and disposing the gas outlets at positions where the air in the pump is compressed as much as possible. Namely, the gas outlets are provided so as to increase the compression ratio. Further, to suppress the amount of the gas backwardly flowing, the exhaust gas of the first stage pump unit of the multi stage pump may be drawn by the latter stage pump unit thereof, or a check valve may be provided to the gas outlet.

In another aspect of the above described functions and effects, for increasing the compression ratio to reduce the compressed space capacity immediately before the exhaust opening, the escape holes 170, which can suppress occurrence of the excessive compression on the side opened to the air where the flow amount of the exhaust gas is large, are provided as the excessive compression suppressing mechanism. Further, the check valves 171, which can suppress backwardly flowing the exhaust gas into the highly vacuumed cylinders via the escape holes 170, are provided as the backward flow suppression mechanism.

The preferred embodiments of the present invention have been described, but the present invention is not limited to the embodiments, and many modifications can be allowed without deviating the spirit of the invention.

| EXPLANATION OF SYMBOLS | |
|---|---|
| 10 | the pump units |
| 10A | the pump unit of the first stage |
| 10B | the pump unit of the latter stage |
| 11 | the oil bath cover |
| 11a | the oil gauge |
| 12 | the pump body of the first stage |

-continued

| EXPLANATION OF SYMBOLS | |
|---|---|
| 13 | the side plate of the first stage |
| 15 | the pump body of the latter stage |
| 16 | the side plate of the latter stage |
| 17 | the muffler case |
| 17a | the gas outlet of the muffler case |
| 17b | the escape hose connection port |
| 17c | the escape pipe connection port |
| 20 | the rotating shaft |
| 20A | the driving rotating shaft |
| 20B | the driven rotating shaft |
| 21 | the driving gear |
| 22 | the driven gear |
| 23 | the driven pulley |
| 30 | the rotor |
| 30A | the rotor of the driving rotating shaft of the first stage |
| 30B | the rotor of the driven rotating shaft of the first stage |
| 30C | the rotor of the driving rotating shaft of the latter stage |
| 30D | the rotor of the driven rotating shaft of the latter stage |
| 35A | the gas inlet of the first stage |
| 35B | the gas inlet of the latter stage |
| 36 | the sucking case |
| 36a | the gas inlet of the sucking case |
| 40 | the bearing |
| 40A | the bearing of the one driving rotating shaft |
| 40B | the bearing of the one driven rotating shaft |
| 40C | the bearing of the other driving rotating shaft |
| 40D | the bearing of the other driven rotating shaft |
| 43 | the oil seal |
| 45 | the shaft seal |
| 50 | the cylinder |
| 50A | the cylinder of the first stage |
| 50B | the cylinder of the latter stage |
| 51A | the compression space of the first stage |
| 51B | the compression space of the latter stage |
| 52 | the end wall portion |
| 52A | the one end wall portion of the cylinder of the first stage |
| 52B | the other end wall portion of the cylinder of the first stage |
| 52C | the one end wall portion of the cylinder of the latter stage |
| 52D | the other end wall portion of the cylinder of the latter stage |
| 53 | the circumferential wall portion |
| 53A | the circumferential wall portion of the first stage |
| 53B | the circumferential wall portion of the latter stage |
| 55A | the gas outlet of the first stage |
| 55B | the gas outlet of the latter stage |
| 60 | the silencer section |
| 61 | the escape box |
| 61a | the outlet of the escape box |
| 62 | the escape pipe |
| 65 | the connection path |
| 66 | the main body portion of the connection case |
| 66a | the path-wall portion |
| 66b | the base portion of the connection case |
| 66c | the inlet of the connection case |
| 66d | the outlet of the connection case |
| 67 | the cover portion of the connection case |
| 67a | the escape outlet of the connection case |
| 68 | the escape hose |
| 70 | the escape hole |
| 71 | the check valve (reed valve) |
| 72 | the fixing bolt |
| 72a | the bolt hole |
| 110 | the pump unit |
| 110A | the pump unit |
| 110B | the pump unit |
| 111 | the one side plate |
| 112 | the pump body |
| 113 | the other side plate |

-continued

| EXPLANATION OF SYMBOLS | |
|---|---|
| 115 | the oil bath section |
| 120 | the rotating shaft |
| 120A | the rotating shaft |
| 120B | the rotating shaft |
| 121 | the gear |
| 122 | the gear |
| 130 | the rotor |
| 130A | the rotor |
| 130B | the rotor |
| 130C | the rotor |
| 130D | the rotor |
| 135A | the gas inlet |
| 135B | the gas inlet |
| 140 | the bearing |
| 140A | the bearing of the one side |
| 140B | the bearing of the one side |
| 140C | the bearing of the other side |
| 140D | the bearing of the other side |
| 143 | the oil seal |
| 150 | the cylinder |
| 150A | the cylinder |
| 150B | the cylinder |
| 151 | the compression space |
| 152 | the end wall portion |
| 152A | the end wall portion |
| 152B | the end wall portion |
| 152C | the end wall portion |
| 152D | the end wall portion |
| 153 | the circumferential wall portion |
| 155 | the gas outlet |
| 155A | the gas outlet |
| 155B | the gas outlet |
| 170 | the escape hole |
| 171 | the check valve (reed valve) |
| 172 | the fixing bolt |
| 172a | the bolt hole |

The invention claimed is:

1. A two-shaft rotary pump, in which two rotating shafts provided with rotors are supported by bearings, such that the two rotors are rotated in a noncontact manner with a small clearance kept therebetween and the two rotors are rotated in a noncontact manner with a small clearance between an inner surface of a cylinder and the two rotors, and a gas sucked into the cylinder and compressed is discharged from the cylinder, the two-shaft rotary pump comprising:

a plurality of escape holes capable of letting a part of the compressed gas escape, including one escape hole in one end wall portion at an axial end of the cylinder, the one end wall portion is located on a cantilever end face-side of the end wall portion and through which no rotating shafts penetrate, and is opened in the axial direction of the rotating shafts, and a check valve, which opens when an inner pressure of the cylinder is higher than a prescribed pressure and closes when the inner pressure of the cylinder is lower than the prescribed pressure, is provided to the escape hole.

2. The two-shaft rotary pump according to claim 1, wherein the check valve is a reed valve.

3. The two-shaft rotary pump according to claim 1, wherein the plurality of escape holes are provided in the wall portion of the cylinder, which constitutes a compressed space for compressing the gas, and the plurality of the escape holes are provided in a manner such that a rate of a total opened area of the plurality of escape holes facing the cylinder, with respect to a capacity of the compressed space which is gradually reduced according to increase of a compression ratio during compressing the gas, is gradually increased during compressing the gas.

4. The two-shaft rotary pump according to claim 1, wherein pump units, each of which is constituted by the cylinder and the two rotors, are provided to both ends of the rotating shafts; and the two rotors of each of the pump units are supported, by bearings which are provided on one axial side of the rotating shafts and between the pump units, in a form of a cantilever through the rotating shafts.

5. The two-shaft rotary pump according to claim 1, further comprising a silencer section forming a silencing space, in which an exhaust gas compressed in the cylinder and discharged from a gas outlet and the exhaust gas discharged from the escape hole are combined and muffled.

6. The two-shaft rotary pump according to claim 1, wherein each of the rotors has hook-shaped claws and is used in a claw pump, and a gas outlet for discharging the gas compressed in the cylinder is provided in the end wall portion in which the escape hole is provided.

7. The two-shaft rotary pump according to claim 1, wherein the plurality of escape holes includes an additional escape hole, which is capable of letting a part of the compressed gas escape, and is provided in a circumferential wall portion of the cylinder, which constitutes a cylindrical portion thereof.

8. A two-shaft rotary pump, in which two rotating shafts provided with rotors are supported by bearings, such that the two rotors are rotated in a noncontact manner with a small clearance kept therebetween and the two rotors are rotated in a noncontact manner with a small clearance between an inner surface of a cylinder and the two rotors, and a gas sucked into the cylinder and compressed is discharged from the cylinder, the two-shaft rotary pump comprising:

a plurality of pump units, each of which is constituted by the cylinder and the two rotors, are arranged in the axial direction of the two rotating shafts, at least one of the pump units is constituted by providing the bearings to the two rotating shafts, on the both sides of the rotors, so as to support both ends, and in at least one of the pump units, at least one escape hole capable of letting a part of the compressed gas escape is provided in one end wall portion at an axial end of the cylinder, which is located on a cantilever end face-side of the end wall portion and through which no rotating shafts penetrate, and is opened in the axial direction of the rotating shafts.

9. The two-shaft rotary pump according to claim 8, wherein the pump unit, which has the rotors provided to the two rotating shafts and is supported in the form of a cantilever, is a final stage pump unit for compressing the gas at the highest pressure.

10. The two-shaft rotary pump according to claim 8, wherein at least one additional escape hole, which is capable of letting a part of the compressed gas escape, is provided in a path-wall portion of a connection path, which connects a gas outlet of the pump unit for a first stage of the gas flow to a gas inlet of the pump unit for a latter part thereof.

11. The two-shaft rotary pump according to claim 10, wherein a check valve, which opens when an inner pressure of the cylinder is higher than a prescribed pressure and closes when the inner pressure of the cylinder is lower than the prescribed pressure, is provided to the escape hole.

12. The two-shaft rotary pump according to claim 8, wherein at least one of the pump units has at least one additional escape hole, which is capable of letting a part of the compressed gas escape and which is provided in a circumferential wall portion constituting a cylindrical portion of the cylinder.

13. The two-shaft rotary pump according to claim 12, wherein a check valve, which opens when an inner pressure of the cylinder is higher than a prescribed pressure and closes when the inner pressure of the cylinder is lower than the prescribed pressure, is provided to the escape hole.

14. The two-shaft rotary pump according to claim 8, wherein a plurality of escape holes, which are capable of letting a part of the compressed gas escape, are provided in the one wall portion of the cylinder, which constitutes a compressed space for compressing the gas, and a plurality of escape holes are provided in a manner such that a rate of a total opened area of the plurality of escape holes facing the cylinder, with respect to a capacity of the compressed space which is gradually reduced according to increase of a compression ratio during compressing the gas, is gradually increased during compressing the gas.

15. The two-shaft rotary pump according to claim 8, wherein a check valve, which opens when an inner pressure of the cylinder is higher than a prescribed pressure and closes when the inner pressure of the cylinder is lower than the prescribed pressure, is provided to the escape hole.

16. The two-shaft rotary pump according to claim 15, wherein the check valve is a reed valve.

17. The two-shaft rotary pump according to claim 8, further comprising a silencer section forming a silencing space, in which an exhaust gas compressed in the cylinder and discharged from the gas outlet and the exhaust gas discharged from the escape hole are combined and muffled.

18. The two-shaft rotary pump according to claim 8, wherein each of the rotors has hook-shaped claws and is used in a claw pump, and a gas outlet for discharging the gas compressed in the cylinder is provided in the end wall portion in which the escape hole is provided.

* * * * *